US007668501B2

(12) United States Patent
Murakami et al.

(10) Patent No.: US 7,668,501 B2
(45) Date of Patent: Feb. 23, 2010

(54) MEDIUM SUPPLYING APPARATUS AND IMAGE FORMING APPARATUS

(75) Inventors: Tatsuya Murakami, Tokyo (JP); Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/965,183

(22) Filed: Dec. 27, 2007

(65) Prior Publication Data

US 2008/0128974 A1 Jun. 5, 2008

Related U.S. Application Data

(63) Continuation of application No. 11/120,688, filed on May 3, 2005, now abandoned.

(30) Foreign Application Priority Data

May 14, 2004 (JP) ..... 2004-145407
Feb. 23, 2005 (JP) ..... 2005-047095

(51) Int. Cl.
*G03G 15/00* (2006.01)
*G03G 21/00* (2006.01)
*B65H 3/44* (2006.01)
*B65H 1/00* (2006.01)

(52) U.S. Cl. ..... 399/392; 399/381; 399/393; 271/9.09

(58) Field of Classification Search ..... 399/320, 399/322, 324, 361, 363, 364, 381, 394, 395, 399/396, 397, 400, 401, 388, 392, 393; 271/3.14–14; 347/104; *G03G 15/00, 21/00; B65H 11/00, B65H 3/44*

See application file for complete search history.

(56) References Cited

U.S. PATENT DOCUMENTS

| | | | | |
|---|---|---|---|---|
| 6,260,840 | B1 | 7/2001 | Suga et al. | |
| 6,836,624 | B2 * | 12/2004 | Suzuki | 399/44 |
| 7,036,813 | B2 | 5/2006 | Asada | |
| 2003/0052956 | A1 | 3/2003 | Katsuyama | |

FOREIGN PATENT DOCUMENTS

| | | | |
|---|---|---|---|
| JP | 05-077507 | A | 3/1993 |
| JP | 05319634 | A * | 12/1993 |
| JP | 09030658 | A * | 2/1997 |
| JP | 09290936 | A * | 11/1997 |
| JP | 10218436 | A * | 8/1998 |
| JP | 11-171360 | A | 6/1999 |
| JP | 11171360 | A * | 6/1999 |
| JP | 2002-046882 | A | 2/2002 |
| JP | 2004131240 | A * | 4/2004 |

* cited by examiner

*Primary Examiner*—Judy Nguyen
*Assistant Examiner*—'Wyn' Q Ha
(74) *Attorney, Agent, or Firm*—Panitch Schwarze Belisario & Nadel LLP

(57) ABSTRACT

A medium supplying apparatus is assembled to an image forming apparatus. A medium tray supports a medium thereon, and is pivotal about a first axis and extends from the first axis. The medium tray has a guide path that extends in the first radial direction. A feeder frame has a pickup roller rotatably mounted to the feeder frame, and is pivotal about a second axis substantially parallel to the first axis. The medium tray and the feeder frame are drivingly coupled via a link. When the medium tray pivots to its open position or closed position, the link transmits the motion of the medium tray to the feeder frame in such a way that the feeder frame drivingly pivots to its open position or closed position.

8 Claims, 39 Drawing Sheets

MEDIUM SUPPLYING APPARATUS AND IMAGE FORMING APPARATUS

CROSS-REFERENCE TO RELATED APPLICATIONS

This application is a continuation of U.S. patent application Ser. No. 11/120,688, filed May 3, 2005, the disclosure of which is incorporated herein by reference.

BACKGROUND OF THE INVENTION

The present invention relates to a medium supplying apparatus and an image forming apparatus.

Conventional image forming apparatus such as printers, copying machines, and facsimile machines include a medium supplying apparatus that feeds sheets of paper to image forming sections.

A medium supplying device is generally of two types: a feed roller-and-friction separator type and a feed roller-and-retarding roller type. For the feed-roller-and-friction separator type, a stack of paper is placed on a paper-supporting platform and a feed roller feeds a top page of the stack of paper into a paper transport path. The medium supplying apparatus includes a separator having a friction creating material in contact with the feed roller. When two or more pages of paper are pulled in between the feed roller and the separator, the separator applies a drag so that only the top page of the stack of paper is fed into the paper transport path.

For the feed roller-and-retarding roller type, a medium feeding member is provided in pressure contact with a top page of a stack of paper raised to a certain level. The medium feeding member includes a pickup roller and a pair of rollers. The pickup roller advances the paper toward a paper transport path. The pair of rollers includes a feed roller and a retarding roller that serves to separate the paper page by page. The retarding roller applies a force that tends to advance the paper in the opposite direction to the feed roller. When only one page of the paper is fed to the retarding roller, the friction between the retarding roller and the paper causes the paper to advance the paper in the forward direction. When more than one page of the paper is advanced, the retarding roller applies a braking force to the paper to separate the pages of the paper so that only the top page is advanced.

The medium supplying apparatus of a feed roller-and-retarding roller type also requires an up-down mechanism that controls the height of a plate-like support on which a stack of paper is held and a medium guide that limits the width of the paper. Therefore, the medium supplying apparatus is necessarily of large overall size.

For accommodating long paper such as A3 paper, for example, a Multi Purpose Tray (MPT) or a manual supply tray may be employed. However, installing the MPT or the manual feeding tray requires a large space and therefore the overall size of the medium supplying apparatus becomes even larger.

BRIEF SUMMARY OF THE INVENTION

An object of the invention is to solve the problems of the aforementioned conventional apparatus.

Another object of the invention is to provide a medium supplying apparatus with small dimensions.

A medium supplying apparatus is assembled to an image forming apparatus. The medium supplying apparatus includes a medium tray, a medium feeding section, and a link. The medium tray supports a stack of medium thereon, the medium tray being pivotal relative to the image forming apparatus. The medium feeding section feeds the medium from the medium tray. The link has one end in engagement with the medium tray and another end in engagement with the medium feeding section. When the medium tray pivots to an open position, the medium feeding section extends outwardly from the image forming apparatus. When the medium tray pivots to a closed position, the medium feeding section is accommodated into the image forming apparatus.

The medium supplying apparatus may further include a discriminator that separates pages of medium fed by the medium feeding section. The discriminator includes an advancing mechanism and a retarding mechanism. When the medium tray is at the closed position, the medium feeding section is aligned substantially with the advancing mechanism and the retarding mechanism.

The medium feeding section is pivotally mounted to the image forming apparatus. The link is pivotal about a pivotal axis of the medium feeding section and is in slidable engagement with the medium tray, so that as the medium tray pivots, the medium feeding section pivots.

A medium supplying apparatus is assembled to an image forming apparatus. The medium feeding apparatus includes a medium tray, a medium feeding section, an urging member, and an abutting member. The medium tray is assembled to the image forming apparatus, the medium tray being movable to open and close relative to the image forming apparatus. The medium feeding section feeds the medium from the medium tray. When the medium tray opens, the medium feeding section is drawn out of the image forming apparatus, wherein when the medium tray closes, the medium feeding section is accommodated into the image forming apparatus. The urging member urges the medium feeding section in a direction in which the medium feeding section pivots. The abutting member is provided on the medium feeding section. When the medium tray pivots to close, the abutting member abuts the medium tray to create a predetermined gap between the medium tray and the medium feeding section.

The medium tray includes an auxiliary support, and the medium feeding section projects from the image forming apparatus in a direction perpendicular to the pivotal axis. When the medium tray is at the closed position, the medium feeding section and the auxiliary support are aligned, and are related such that $$L1>L2+L3$$

where L1 is a length of the medium tray, L2 is a distance between the pivotal axis and an end of the medium feeding section, and L3 is a length of the auxiliary support.

The medium tray has a pair of guide members aligned in a direction substantially parallel to a pivotal axis about which the medium tray pivots. When the medium tray is at the closed position, the medium feeding section and the pair of guide members are related such that W2>W1 where W1 is a dimension of the medium feeding section in a direction parallel to the axis, and W2 is a distance between the pair of guide members.

The medium tray includes a medium support platform, a height-adjusting mechanism, and a detector. The medium support platform supports the medium thereon. When the medium tray is at the open position, the height-adjusting mechanism adjusts a height of the medium support platform relative to the medium feeding section. The detector is mounted to the supporting member and detecting whether the medium is present on the medium support platform. The height-adjusting mechanism adjusts the height of the medium support platform in accordance with a detection output of the detector.

The height adjusting mechanism includes a first urging member and a stopper member. The first urging member urges the medium support platform toward the medium feeding section. The stopper member abuts the medium support platform to limit the height of the medium support platform. The stopper member includes an arm that abuts the medium support platform, a holder that holds the arm in such a way that the arm is slidable engagement with the holder, and a second urging member that urges the arm outwardly of the holder. When the medium tray pivots to the closed position, the medium support platform presses the arm against an urging force of the second urging member so that stopper member becomes shorter.

The medium support platform is made of a metal material and the arm and the holder are made of an electrically conductive material.

The link is removably assembled to the medium feeding section and the medium tray.

The medium supplying apparatus may further include a discriminator that separates pages of medium fed by the medium feeding section. The discriminator includes an advancing mechanism that causes a top page of the stack of medium to advance and a retarding mechanism that retards pages under the top page. When the medium tray pivots to the closed position, the advancing mechanism moves away from the retarding mechanism.

The medium supplying apparatus may further include a detector and a controller. The detector detects whether the link is normally coupled to the medium tray. The controller that determines based on a detection output of the detector whether the image forming apparatus should form an image.

The medium supplying apparatus may further include a mounting member. When the mounting member is at a locked position, the link is coupled to the medium tray. When the mounting member, is at an unlocked position, the mounting member is disassembled from the medium tray but remains in engagement with the link.

An image forming apparatus incorporates the aforementioned medium supplying apparatus. The image forming apparatus further includes an image bearing body, a charging section, an exposing section, a developing section, and a transfer section. The charging section charges a surface of the image bearing body. The exposing section irradiates the charged surface of the image bearing body to form an electrostatic latent image. The developing section develops the electrostatic latent image into a visible image. The transfer section transfers the visible image onto a medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The present invention will become more fully understood from the detailed description given hereinbelow and the accompanying drawings which are given by way of illustration only, and thus are not limiting the present invention, and wherein:

FIG. 21A is a partially cross-sectional view of the sensor according to the fourth embodiment when the sensor is ON;

DETAILED DESCRIPTION OF THE INVENTION

First Embodiment

Embodiments of the invention will be described in detail with reference to the accompanying drawings. In the embodiment, an image forming apparatus will be described in terms of a printer. A description will be given of a medium supplying apparatus that supplies paper to image forming sections. The medium in the embodiment includes paper, transparency, filmsy, and envelopes.

Figure 1:
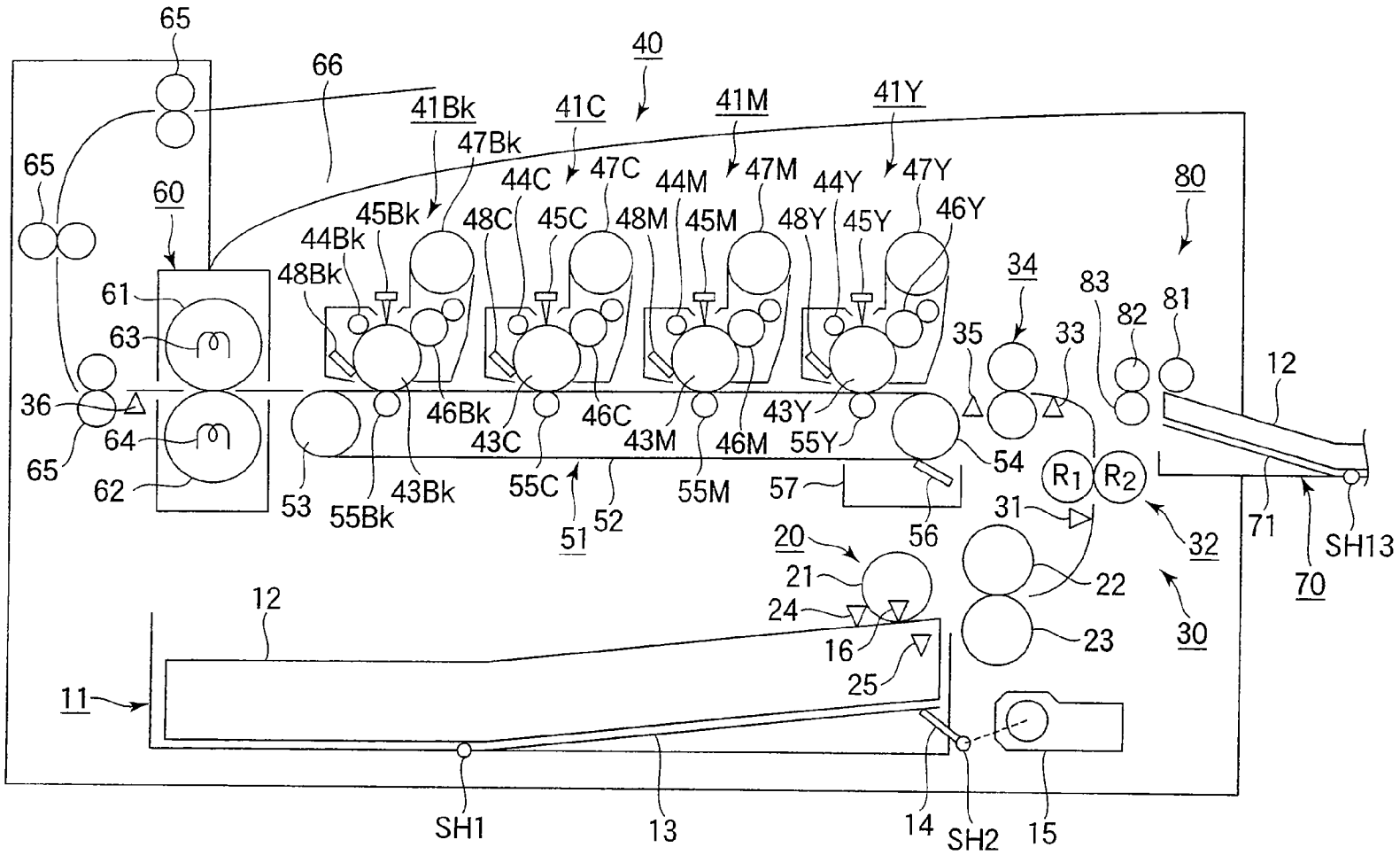
FIG. 1 is a schematic view of a printer according to the present invention.

FIG. 1 is a schematic view of a printer. Referring to FIG. 1, a paper tray 11 is detachably mounted to the body of the printer, and holds a stack of paper 12. The paper tray 11 includes a medium supporting platform 13 that supports the stack of paper 12 thereon and can pivot about a shaft SH1.

The paper tray 11 also includes a guide member, not shown, that limits the position of the paper 12 in the paper tray 11. The guide member extends in a direction substantially perpendicular to a direction in which the paper 12 is advanced, thereby positioning the paper 12 in the paper tray 11.

A lift-up lever 14 is provided at an exit of the paper tray 11 and is pivotally mounted on a shaft SH2. The shaft SH2 is detachably coupled to a motor 15.

When the paper tray 11 is installed into the image forming apparatus, the lift-up lever 14 is coupled to the motor 15. A controller drives the motor 15 to cause the lift-up lever 14 to pivot so that the tip of the lift-up lever 14 abuts the bottom of the medium supporting platform 13. The left-up lever 14 lifts the forward end portion of the medium supporting platform 13 so that the leading end portion of the stack of paper 12 is raised. When the leading end portion of the paper 12 raises to a certain height, a first height detector 16 detects the height of the stack of the paper 12, and provides a detection signal to the controller. In response to the detection signal, the controller causes the motor 15 to stop so that the lift-up lever 14 stops rotating.

A medium feeding section 20 is disposed at the forward end of the paper tray 11, and moves into pressure contact with the leading end portion of the stack of the paper 12. The medium feeding section 20 includes a pickup roller 21, a feed roller 22, and a retarding roller 23. The medium feeding section 20, paper tray 11, and the lift-up lever 14 form a first medium supplying mechanism in the present invention. The pickup roller 21 feeds the paper 12. The retarding roller 23 serves to separate pages of the paper 12. The feed roller 22 and the retarding roller 23 cooperate with each other to operate as a paper discriminator. The medium feeding section 20 includes a remaining medium detector 25 disposed adjacent the height detector 16. The remaining medium detector 25 is a certain distance below a first medium detector 24 and the first height detector 16.

The paper 12 is advanced by the medium feeding section 20 and is separated by the feed roller 22 and retarding roller 23 before the paper 12 advances to a medium transporting section 30. When the paper 12 passes by the sensor 31, the sensor 31 detects the leading end of the paper 12 and provides a detection signal to the controller. The paper 12 then advances to a transport roller pair 32 that includes a roller R1 and a roller R2.

When the controller receives the detection signal from the sensor 31, the controller does not drive a motor, not shown, to immediately rotate but allows the paper 12 to abut the rollers R1 and R2 to remove its skew. Then, the controller starts to drive the motor to rotate so that the paper 12 is advanced to the image forming sections. In other words, the controller drives the motor into rotation at a delayed timing after receiving the detection signal.

Subsequently, the paper 12 passes a sensor 35 to the image forming sections 41Y. Upon detecting the leading end of the paper 12, the sensor 35 sends a detection signal to the controller.

There are four image forming sections 41Y, 41M, 41C, and 41BK for forming yellow, magenta, cyan, and black toner images, respectively. The image forming sections 41Y, 41M, 41C, and 41BK form transfer points between corresponding transfer rollers 55Y, 55M, 55C, and 55BK, respectively. The toner images of the corresponding colors are transferred onto the paper 12 as the paper 12 passes through the respective transfer points in sequence.

Charging rollers 44Y, 44M, 44C, and 44BK charge the entire surfaces of photoconductive drums 43Y, 44M, 44C, and 44BK, respectively, to a uniform potential. Then, print heads 45Y, 45M, 45C, and 45BK illuminate the charged surfaces of the photoconductive drums 43Y, 44M, 44C, and 44BK, respectively, to form an electrostatic latent image in accordance with print data. Developing rollers 46Y, 46M, 46C, and 46BK supply yellow, magenta, cyan, and black toners, to the respective electrostatic latent images, respectively, so that the electrostatic latent images are developed into yellow, magenta, cyan, and black toner images, respectively. Toner tanks 47Y, 47M, 47C, and 47BK supply fresh toners to the developing rollers 46Y, 44M, 44C, and 44BK. Cleaning devices 48Y, 48M, 48C, and 48BK remove residual toners on the photoconductive drums 43Y, 43M, 43C, and 43BK after transfer of the toner images of the respective colors onto the paper 12.

The print heads 45Y, 45M, 45C, and 45BK are in the form of an LED array. A transfer section 51 is disposed under the image forming sections 41Y, 41M, 41C, and 41BK. A transport motor, not shown, drives a transporting mechanism. A drive roller 53 is driven by the transport motor in rotation. A tension roller 54 is rotatably disposed at a distance away from the drive roller 53. A transfer belt 52 is entrained about the drive roller 53 and the tension roller 54. When the drive roller 53 rotates, the transfer belt 52 runs with the paper 12 electrostatically attracted to the transfer belt 52. Transfer rollers 55Y, 55M, 55C, and 55BK are in pressure contact with the photoconductive drums 43Y, 43M, 43C, and 43BK and transfer the toner images of the corresponding colors onto the paper 12. Cleaning blades 56Y, 56M, 56C, and 56BK scrape the toners adhering to the transfer belt 52 after transfer of the toner images of the respective colors. A toner box 57 collects the toners scraped by the cleaning blades 56Y, 56M, 56C, and 56BK from the transfer belt 52.

The image forming sections 41Y, 41M, 41C, and 41BK and the transfer belt 52 operate in synchronism, so that the toner images of the corresponding colors are transferred onto the paper 12 carried on the transfer belt 52 in sequence to form a full color toner image. The paper 12 carries a full color toner image on it and advances to a fixing unit 60.

The fixing unit 60 includes an upper roller 61 and a lower roller 62. The upper roller 61 incorporates a halogen lamp 63 as a heat source. The lower roller 62 incorporates a halogen lamp 64 as a heat source. When the paper 12 passes a fixing point defined between the upper roller 61 and the lower roller 62, the full color toner image is fused into a full color permanent image under pressure and heat applied by the upper and lower rollers 61 and 62. The paper 12 passes a paper discharge sensor 36, which in turn provides a detection signal to the controller. The paper 12 is further advanced by a plurality of discharging roller pairs 65 to a stacker 66.

Figure 2A:
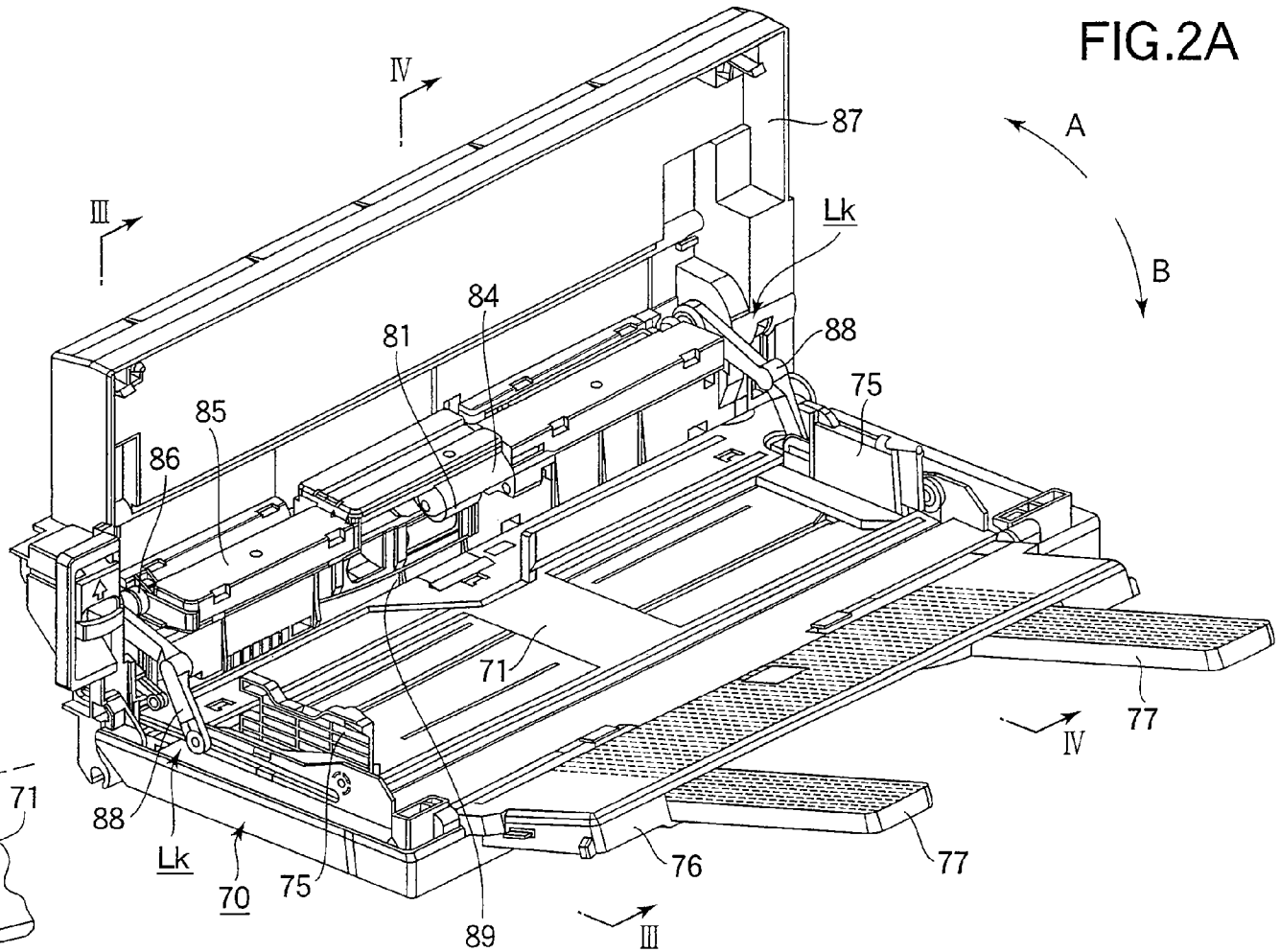
FIG. 2A is a perspective view of the second medium supplying mechanism.

FIG. 2A is a perspective view of a second medium supplying mechanism.

Figure 2B:
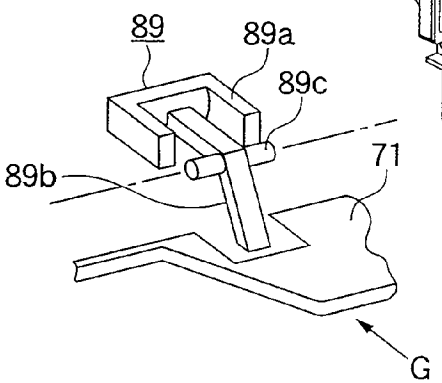
FIG. 2B is a perspective view of a second medium detector.

FIG. 2B is an enlarged perspective view of a second medium detector 89.

Figure 3:
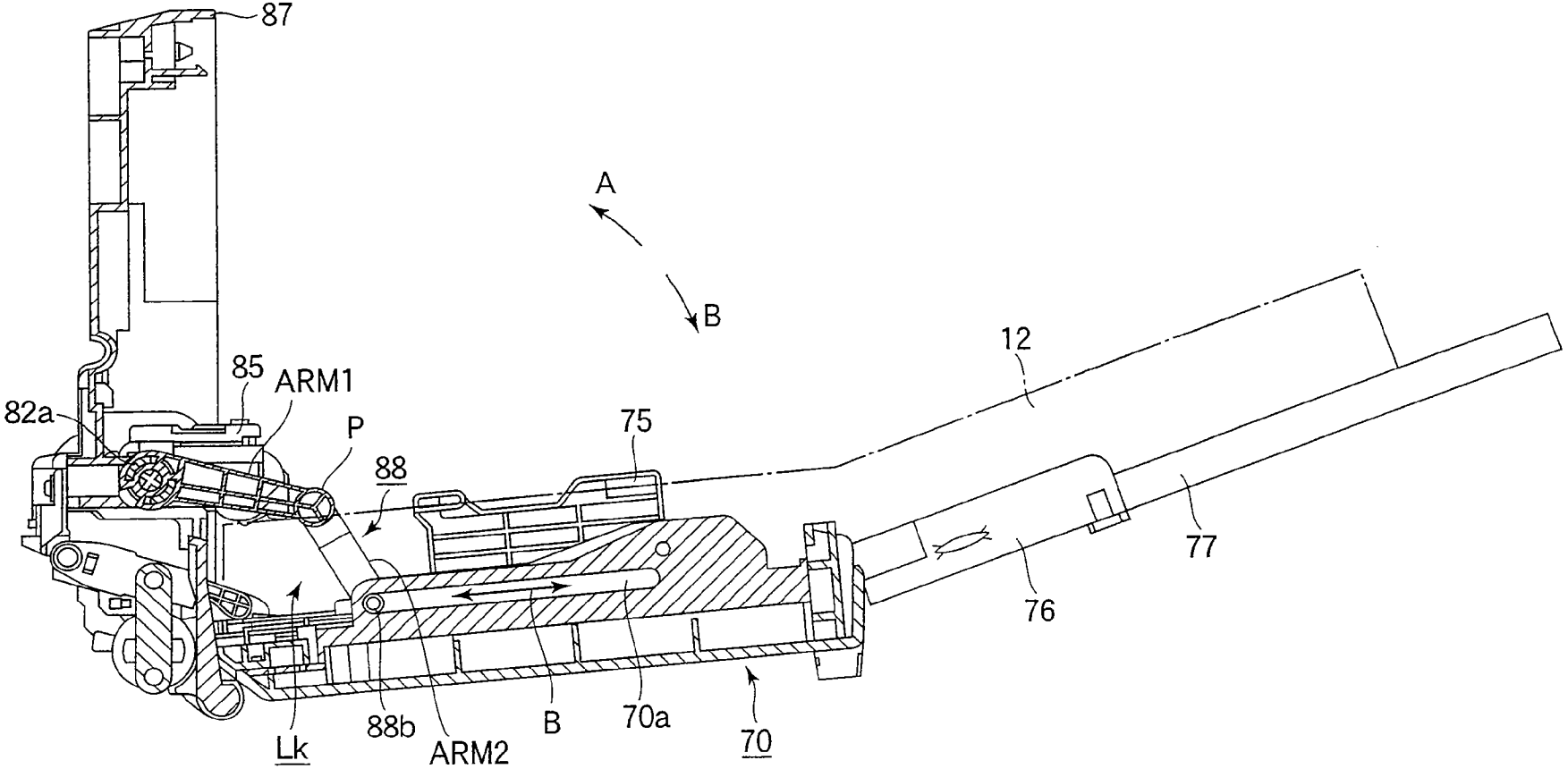
FIG. 3 is a cross-sectional side view taken along a line III-III of FIG. 2A illustrating the operation of a link mechanism for a second medium supplying mechanism according to a first embodiment.

FIG. 3 is a cross-sectional side view taken along a line III-III of FIG. 2 illustrating the operation of the link mechanism LK for the second medium supplying mechanism according to the first embodiment.

Figure 4:
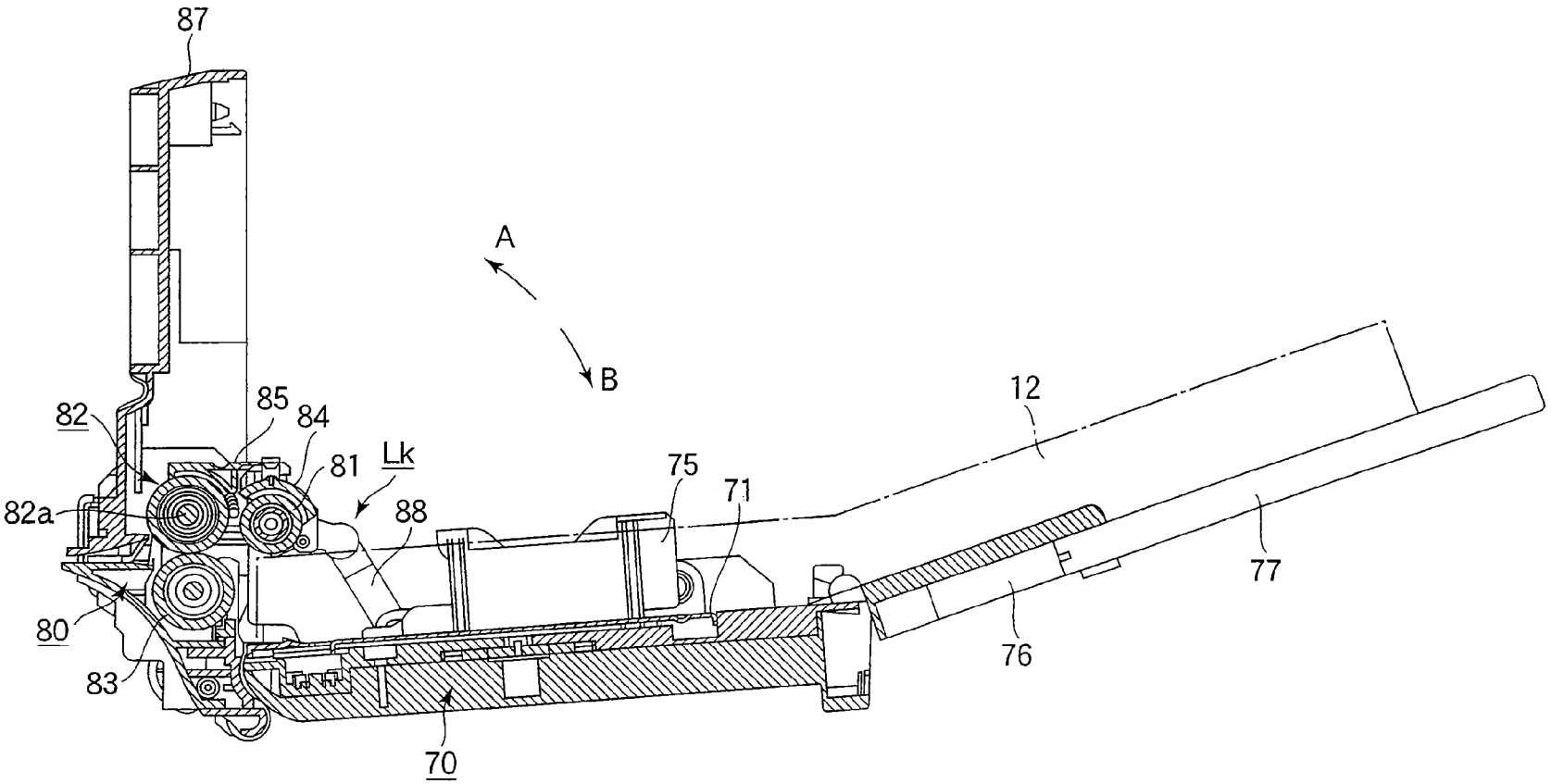
FIG. 4 is a cross-sectional side view of the second medium supplying mechanism taken along a line IV-IV of FIG. 2A.

The image forming apparatus according to the present invention also includes the second medium supplying mechanism as shown in FIG. 2A. The second medium supplying mechanism in FIG. 2A provides smooth supply of a long paper (e.g., A3 paper), thin paper, thick paper, narrow-width paper and the like, which cannot be handled by the first medium supplying mechanism, to the image forming sections 41Y, 41M, 41C, and 41Bk. The second medium supplying mechanism includes a paper tray 70 and a medium feeding section 80 (FIG. 4). Referring to FIG. 2B, the second medium supplying mechanism also includes a second medium detector 89 that detects the present or absence of medium and a height detector, not shown, that detects the height of the stack of the paper 12. The second medium detector 89 takes the form of a photo sensor that includes a photo detector 89*a*, a lever 89*b* that pivots about a shaft 89*c*. When the paper 12 is advanced in a direction shown by arrow G, the leading edge of the paper 12 pushes one end portion of the lever 89*b* so that the photo detector 89*a* detects the passage of the paper 12. The paper tray 70 extends outwardly of the image forming apparatus.

The paper tray 70 can pivot relative to the image forming apparatus in directions shown by arrows A and B. The paper tray 70 is opened in the B direction when it is used to supply paper and closed in the A direction when it is not used to supply paper. The paper tray 70 serves as a multi purpose tray (MPT) or a manual insertion tray.

Figure 11:
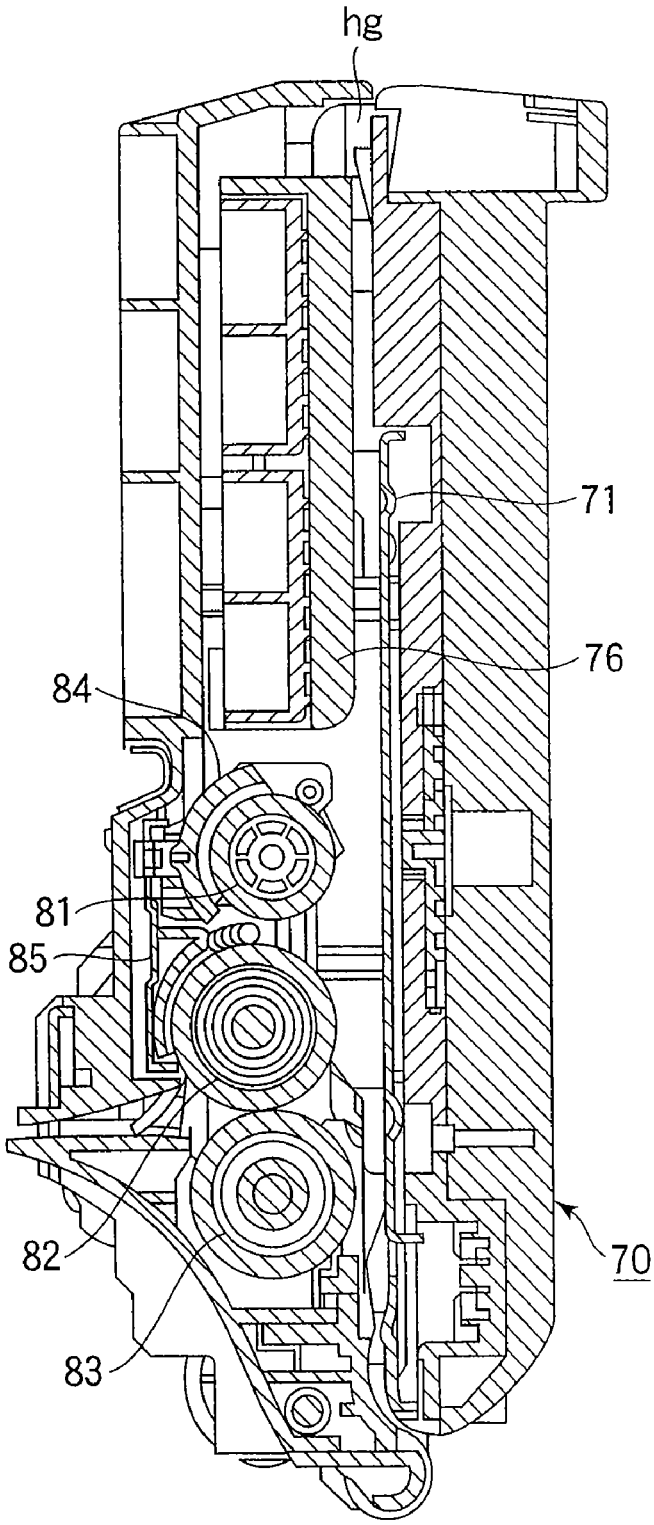
FIG. 11 is another cross-sectional side view illustrating a pickup roller when the paper tray is closed.

The paper tray 70 includes guide members 75, a medium-supporting platform 71 (FIG. 2A), a first auxiliary support 76 and a second auxiliary support 77. Prior to the closing operation of the paper tray 70, the second auxiliary support 77 (FIG. 1) is pushed into the first auxiliary support 76 by a predetermined length, and the first auxiliary support 76 is then folded by rotating about a hinge hg (FIG. 11).

The guide members 75 limit and guide the side edges of the paper 12. The medium-supporting platform 71 supports a stack of paper 12 on it when the paper tray 70 is in use. The medium-supporting platform 71 is pivotal about a shaft SH13 (FIG. 1) to raise and lower the paper 12. The first auxiliary support 76 and second auxiliary support 77 form an auxiliary support section.

FIG. 4 is another cross-sectional side view of the second medium supplying mechanism taken along a line IV-IV of FIG. 2A. The medium feeding section 80 is disposed in the vicinity of the paper tray 70 and cooperates with the paper tray 70. The medium feeding section 80 includes a pickup roller 81 and a paper discriminator. The paper discriminator includes a feed roller 82 and a retarding roller 83. The pickup roller 81 picks up the top page of the stack of the paper 12. The paper discriminator separates the pages of the paper 12 to feed one page at a time. The medium feeding section 80 includes a medium sensor, not shown, that detects the presence or absence of the paper 12 and a position detector, not shown, that detects the height of the stack of the paper 12 and the position of the pickup roller 81.

The paper 12 shown in phantom lines is advanced by the pickup roller 81 from the paper tray 70. The feed roller 82 and retarding roller 83 cooperate with each other to separate the pages of the paper 12 and then to cause the paper 12 to advance to a medium transport path.

Figure 5:
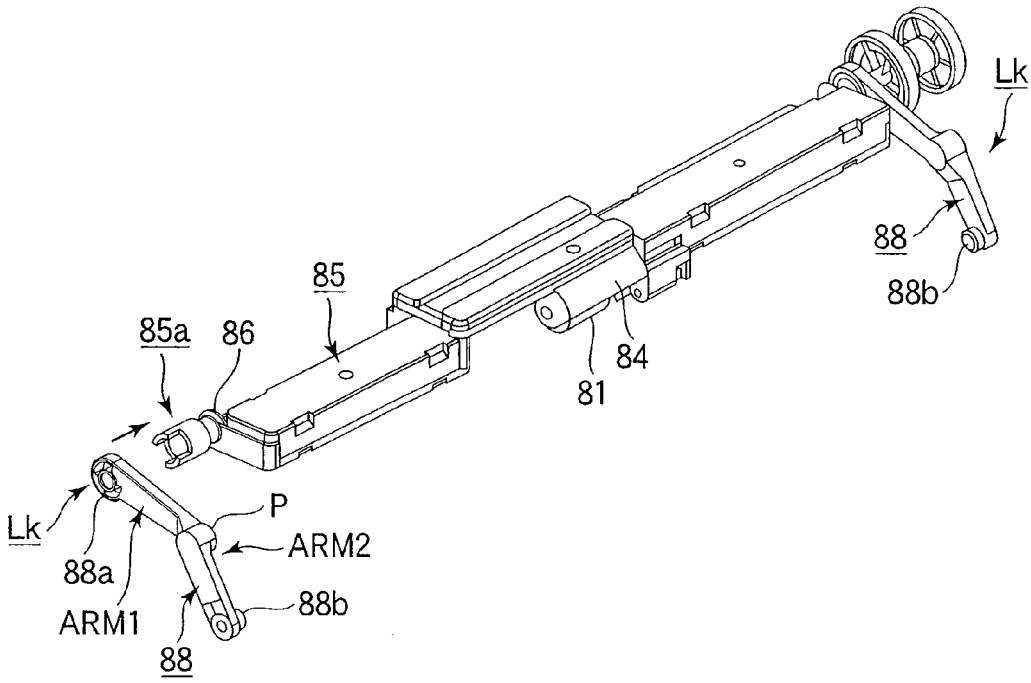
FIG. 5 is a perspective view illustrating the link mechanism and a feeder frame.

The pickup roller 81 is rotatably supported on the pickup frame 84. The pickup frame 84 is supported in such a way that the pickup frame 84 can pivot about an axis 82*a* (FIG. 6) relative to feeder frames 85. Thus, the pickup frame 84 and feeder frame 85 move in unison. The feeder frames 85 are supported on a main frame 87 and are pivotal about a shaft 86 (FIG. 5). The shaft 86 and the paper tray 70 are coupled via a link mechanism LK. The link mechanism LK has a link 88 as a coupling member that couples the paper tray 70 and the feeder frames 85. The pickup roller 81, pickup frame 84, and feeder frames 85 form a medium supplying apparatus. The link mechanism LK is provided on both sides of the paper tray.

Figure 6:
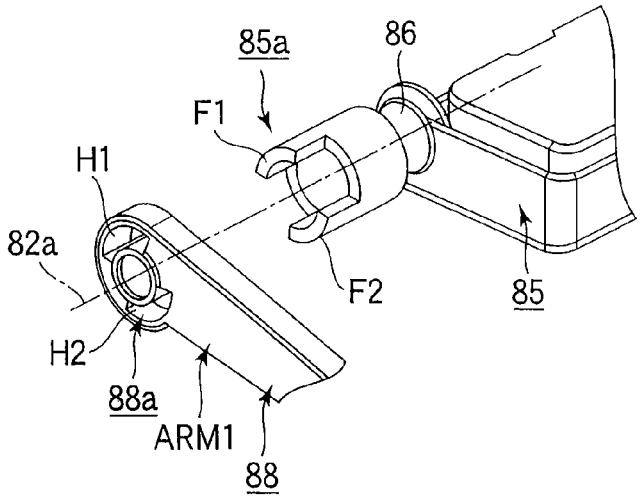
FIG. 6 is a fragmentary perspective view illustrating a pertinent portion of FIG. 5.

FIG. 5 is a perspective view illustrating the link mechanism LK and feeder frame 85. FIG. 6 is a fragmentary perspective view illustrating a pertinent portion of FIG. 5.

Referring to FIGS. 5 and 6, the link 88 includes a first arm ARM 1 and a second arm ARM 2 that extend from their ends P and makes an angle with each other. The feeder frames 85 and the paper tray 70 are pivotally coupled to each other by way of the links 88. For this purpose, each of the feeder frames 85 is formed with a projection 85*a* and the first arm ARM 1 has a hole 88*a* formed in its one end portion. The feeder frame 85 and first arm ARM1 are detachably coupled by means of the projection 85*a* and the hole 88*a*. The projections 85*a* has engagement portions F1 and F2 diametrically oppositely disposed with respect to the axis 82*a*, and is rotatable about the axis 82*a*. The holes H1 and H2 are formed in the first ARM1 of the link 88 and are diametrically opposite with respect to the axis 82*a*. The engagement portions F1 and F2 fit into holes H1 and H2, respectively.

Referring back to FIG. 3, the paper tray 70 has an elongated hole 70*a* formed therein, the elongated hole 70*a* fittingly receiving a boss 88*b* formed on one end portion of the second arm ARM 2. When the paper tray 70 is opened or closed relative to the image forming apparatus, the boss 88*b* slides in the elongated hole 70*a* in a direction shown by arrow B.

While the engagement portions F1 and F2 and holes H1 and H2 are in the shape of a sector, they may be other shapes such as a cross-shaped projection-and-recess engagement that establish a complementary engagement between the projection 85*a* and the link 88. While the arms ARM 1 and ARM2 are at an obtuse angle with each other, they may be at an acute angle with each other.

The link mechanism LK will now be described.

Figure 7:
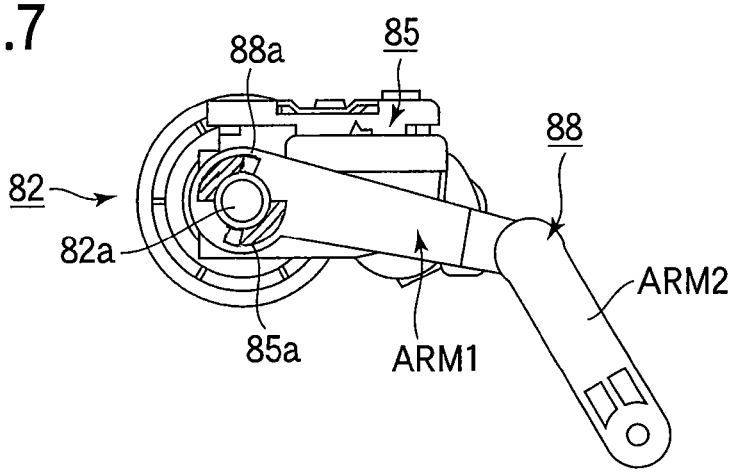
FIGS. 7-9 illustrate the operation of the link mechanism.
Figure 8:
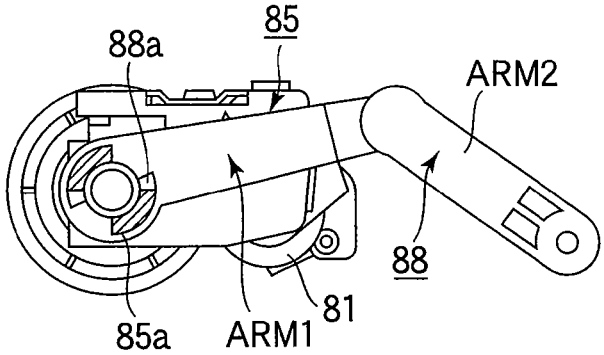
Figure 9:
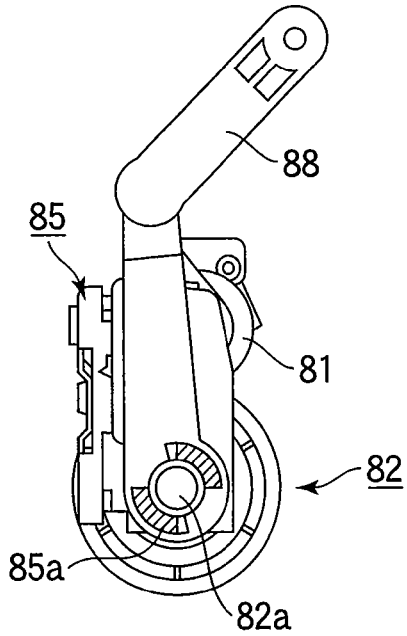
Figure 10:
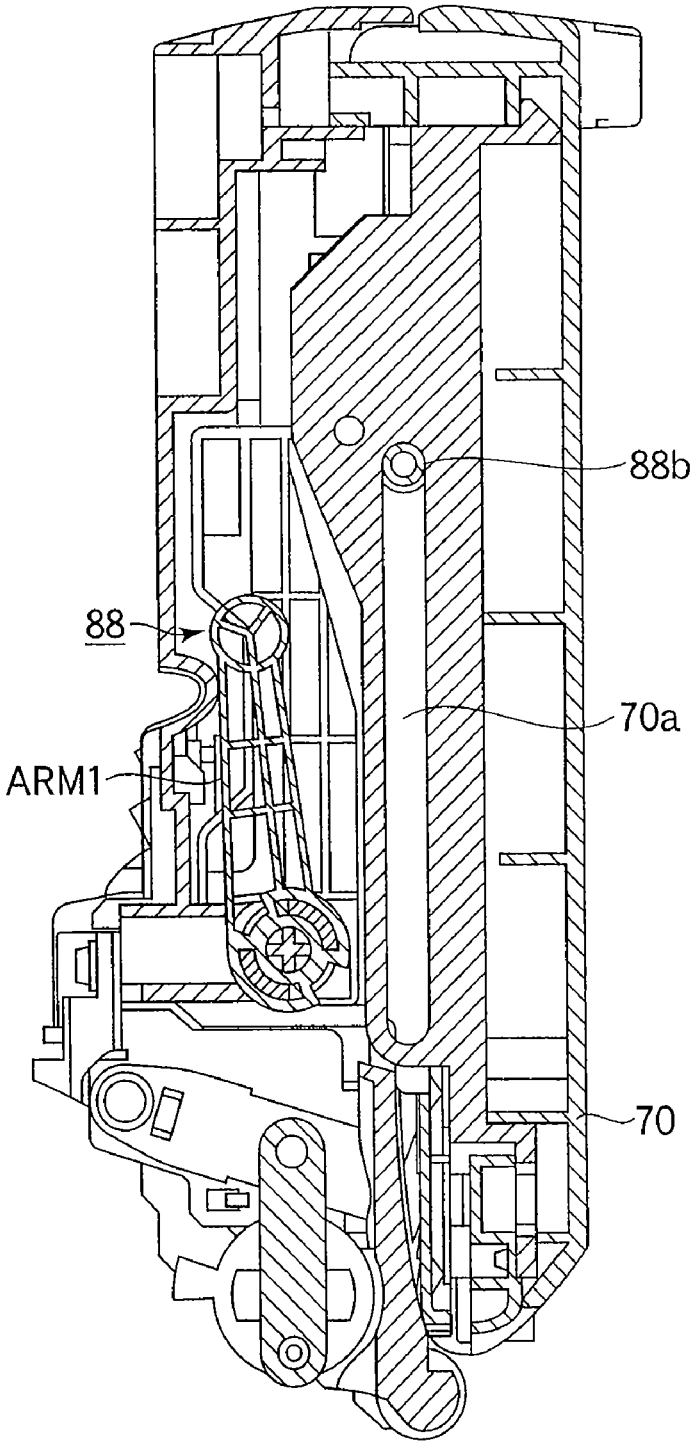
FIG. 10 is a cross-sectional side view illustrating the link when a paper tray is closed.

FIGS. 7-9 illustrate the operation of the link mechanism LK. FIG. 10 is a cross sectional side view illustrating the link 88 when the paper tray 70 is closed. FIG. 11 is another cross sectional side view illustrating the pickup roller 81 when the paper tray 70 is closed.

When the operator operates the paper tray 70 to pivot into the image forming apparatus to close the paper tray 70, the boss 88*b* of the link 88 slides in the elongated hole 70*a* toward the body of the apparatus. When the user operates the paper tray 70 to pivot outwardly from the image forming apparatus to open the paper tray 70, the boss 88*b* slides in the elongated hole 70*a* in the opposite direction. FIGS. 7-9 illustrate the positional relationship between the projection 85*a* and the hole 88*a* when the paper tray 70 is opened and closed. It is to be noted that the circumferential dimension of the hole 88*a* is larger than that of the projection 85*a* such that the engagement portions f1 and F2 of the projections 85*a* can rotate in the holes 88*a* relative to the link 88.

When the paper tray 70 is opened as shown in FIG. 1, the engagement portions F1 and F2 of the projections 85*a* are at circumferential forward ends in the holes 88*a* as shown in FIG. 7, creating gaps between the projections 85*a* and the circumferential rearward ends of the holes 88*a*.

When the paper tray 70 is rotated through an angle in such a direction as to close the paper tray 70, the rearward ends of the projections 85*a* move into contact with the rearward ends of the holes 88*a* as shown in FIG. 8.

When the paper tray 70 further pivots to the closed, the rearward ends of the holes 88*a* push up the rearward ends of the projections 85*a*, so that the feeder frame 85 is moved drivingly about the axis 82*a* and consequently the pickup roller 81 also rotates about the axis 82*a*. As a result, the pickup roller 81 takes up a position above the feed roller 82 as shown in FIGS. 9 and 11. At this moment, the pickup roller 81 is substantially aligned with the feed roller 82 and the retarding roller 83. As shown in FIG. 10, the paper tray 70 is accommodated in the image forming apparatus and is positioned upward.

When the paper tray 70 is opened, the paper tray 70 is rotated through an arbitrary angle so that the forward ends of the projections 85*a* contact the forward ends of the holes 88*a*. When the paper tray 70 is opened further, the forward ends of the holes 88*a* push down the forward ends of the projections 85*a*.

As described above, when the paper tray 70 is pivoted toward the open position, the pickup roller 81 and link 88 are drivingly moved in a direction away from the apparatus and are dismounted from the main frame 87, so that the pickup roller 81 is at the same height as the feed roller 82. When the paper tray 70 is closed, the pickup roller 81 and link 88 are drivingly moved in a direction toward the apparatus and are mounted into the main frame 87, so that the pickup roller 81 is above the feed roller 82. Thus, this structure offers a small overall size of the apparatus.

The operation will be described in which the paper tray 70, the first and second auxiliary supports 76 and 77 are accommodated into the image forming apparatus.

Figure 12:
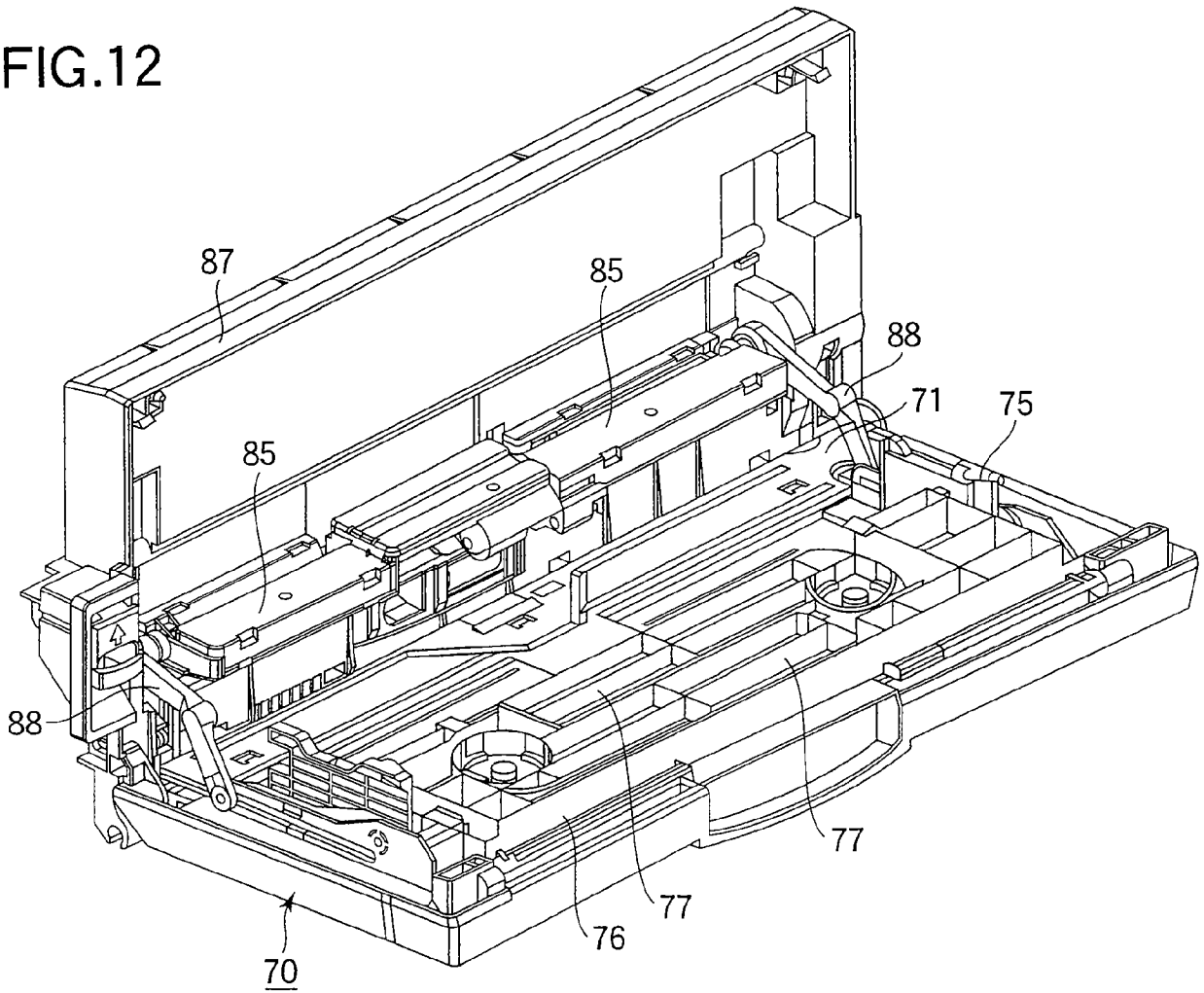
FIG. 12 is a perspective view illustrating the operation in which auxiliary supports are accommodated in the paper tray.
Figure 13:
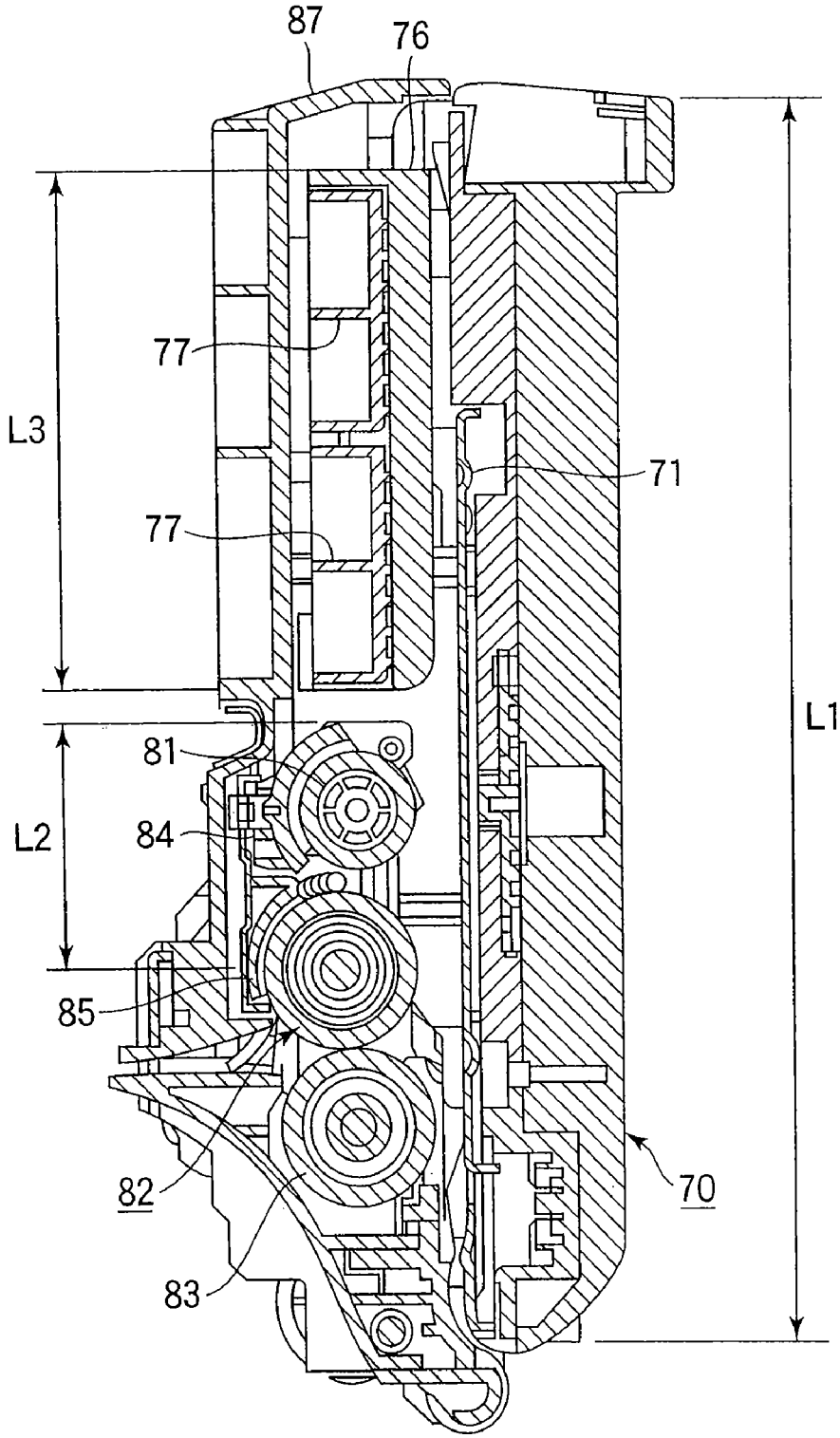
FIG. 13 illustrates the positional relationship among the auxiliary supports, feeder frame, and paper tray.

FIG. 12 is a perspective view illustrating the operation in which the auxiliary support section (i.e., first and second auxiliary supports 77 and 76) has been pushed into the paper tray 70. FIG. 13 illustrates the positional relationship among the first auxiliary support 76, pickup frame 84, and paper tray 70 after the paper tray 70 has been completely accommodated into the image forming apparatus. Elements similar to those in FIGS. 1-11 have been given the same reference numerals and the description thereof is omitted.

When the paper tray 70 is closed, the operator pushes the second auxiliary support 77 into the first auxiliary support 76 and then operates the entire auxiliary support section to pivot about the hinge hg into the paper tray 70.

As described previously, when the paper tray 70 is closed, the pickup roller 81 is drivingly rotated about the axis 82*a* so that the paper tray 70 is accommodated in the image forming apparatus. At this moment, as shown in FIG. 13, the first and second auxiliary supports 76 and 77 are substantially aligned with a top portion of a pickup frame 84 which supports the pickup roller 81.

The pickup frame 84 and first auxiliary supports 76 are related such that L1>L2+L3, where L1 is the length of the paper tray 70, L2 is the distance between the axis 82*a* and the end of the pickup frame 84, and L3 is the length of the first auxiliary support 76. This relation prevents the auxiliary support section from interfering with, for example, the pickup roller 81 and the pickup frame 84, and implements a medium-supplying apparatus of small size.

Second Embodiment

Elements similar to those of the first embodiment have been given the same reference numerals and the description is omitted.

Figure 14:
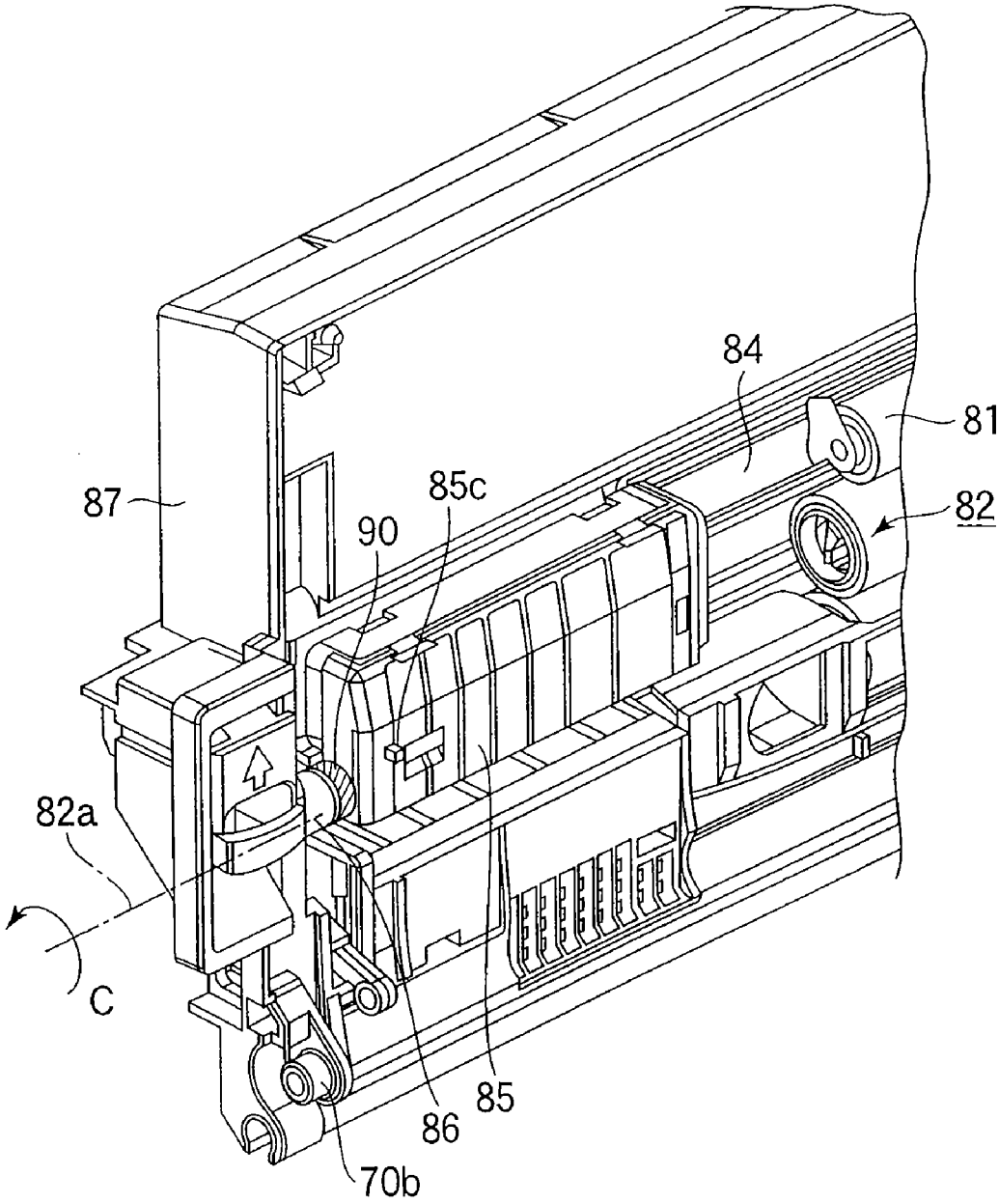
FIG. 14 is a perspective view of a feeder frame according to a second embodiment illustrating the feeder frame when the paper tray is closed.
Figure 15:
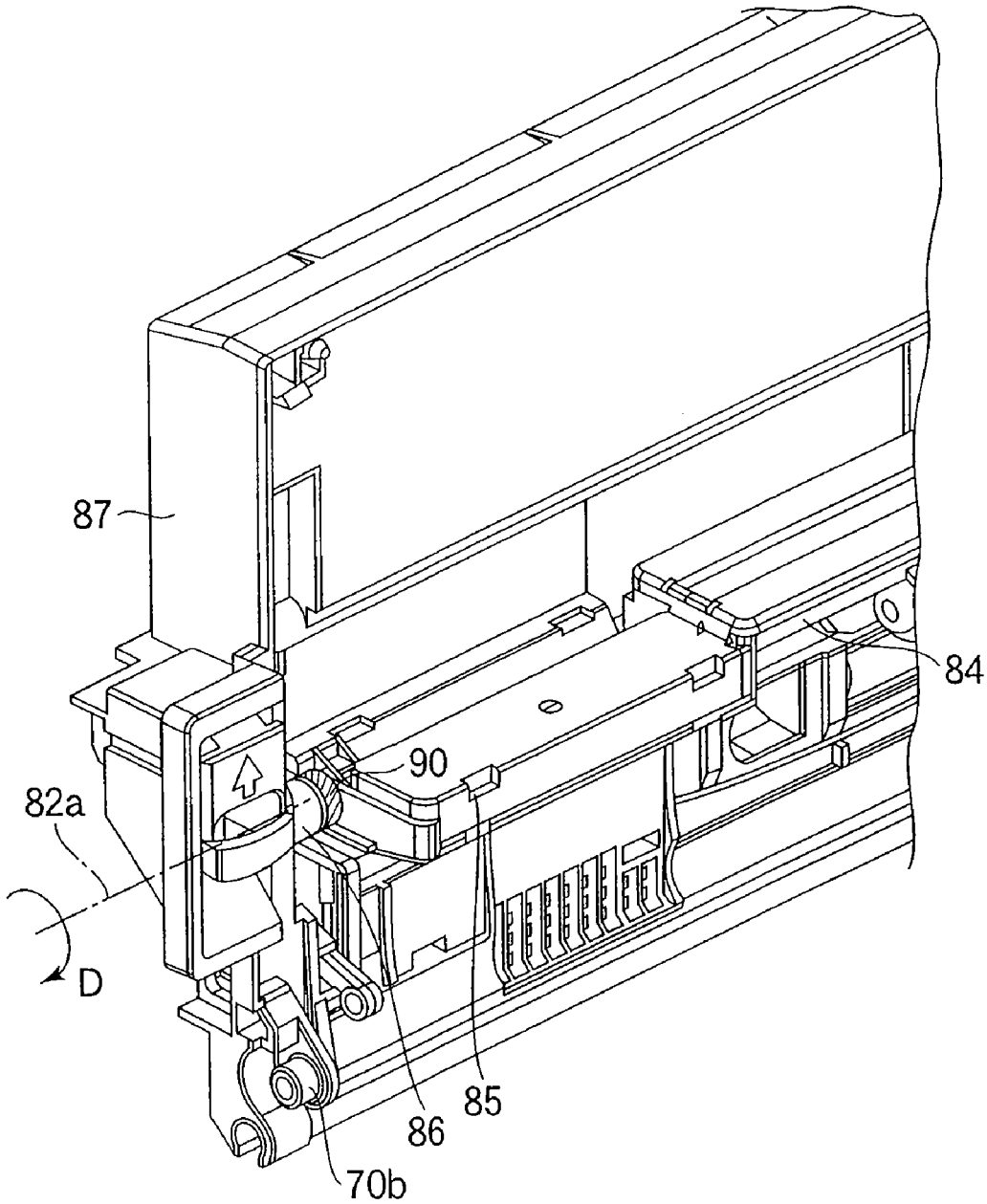
FIG. 15 is a perspective view illustrating the feeder frame when the paper tray is opened.

FIG. 14 is a perspective view illustrating the position of a feeder frame 85 when a paper tray 70 is closed. FIG. 15 is a perspective view illustrating the position of the feeder frame 85 when the paper tray 70 is opened.

A pickup roller 81 is rotatably supported on a pickup frame 84. The pickup roller 81 is pivotal about an axis 82*a* of a feed roller 82 and is supported on the feeder frame 85. The feeder frame 85 has a projection 85*c* that moves into abutting engagement with the paper tray 70 to ensure a predetermined height of a medium transport path through which the paper 12 advances. The feeder frame 85 is supported on a main frame 87 in such a way that the feeder frame 85 is pivotal about a shaft 86. The pickup roller 81, pickup frame 84, and feeder frame 85 form a medium supplying apparatus.

A torsion spring 90 is mounted on the shaft 86 in a manner, not shown, with its one end engaging the main frame 87 and its other end engaging the feeder frame 85. The torsion spring 90 urges the feeder frame 85, pickup frame 84, and pickup roller 81 in a direction shown by arrow D FIG. 15.

The operation of the second medium supplying mechanism of the aforementioned configuration will be described.

When the paper tray 70 (FIG. 1) pivots about a pivot shaft 70*b* toward the image forming apparatus through an angle, the paper tray 70 abuts the feeder frame 85. When the paper tray 70 further pivots toward the image forming apparatus, the paper tray 70 pushes the feeder frame 85, so that the feeder frame 85 rotates about the axis 82*a* in a direction shown by arrow C and is then received into the image forming apparatus as shown in FIG. 14. At this moment, the torsion spring 90 is twisted against its urging force.

When the paper tray 70 pivots about the pivot shaft 70*b* away from the image forming apparatus, the urging force of the torsion spring 90 causes the feeder frame 85 to pivot about the axis 82*a* in a direction shown by arrow D until the feeder frame 85 reaches its operative position where a limiting member, not shown, prevents the feeder frame 85 from pivoting any further.

As described above, the paper tray 70 and the feeder frame 85 are drivingly coupled by means of the torsion spring 90. The torsion spring eliminates the need for using the link 88 used in the first embodiment. This configuration reduces the number of parts and hence the manufacturing cost of the medium supplying apparatus.

Third Embodiment

Elements similar to those of the first embodiment have been given the same reference numerals and the description is omitted.

Figure 16:
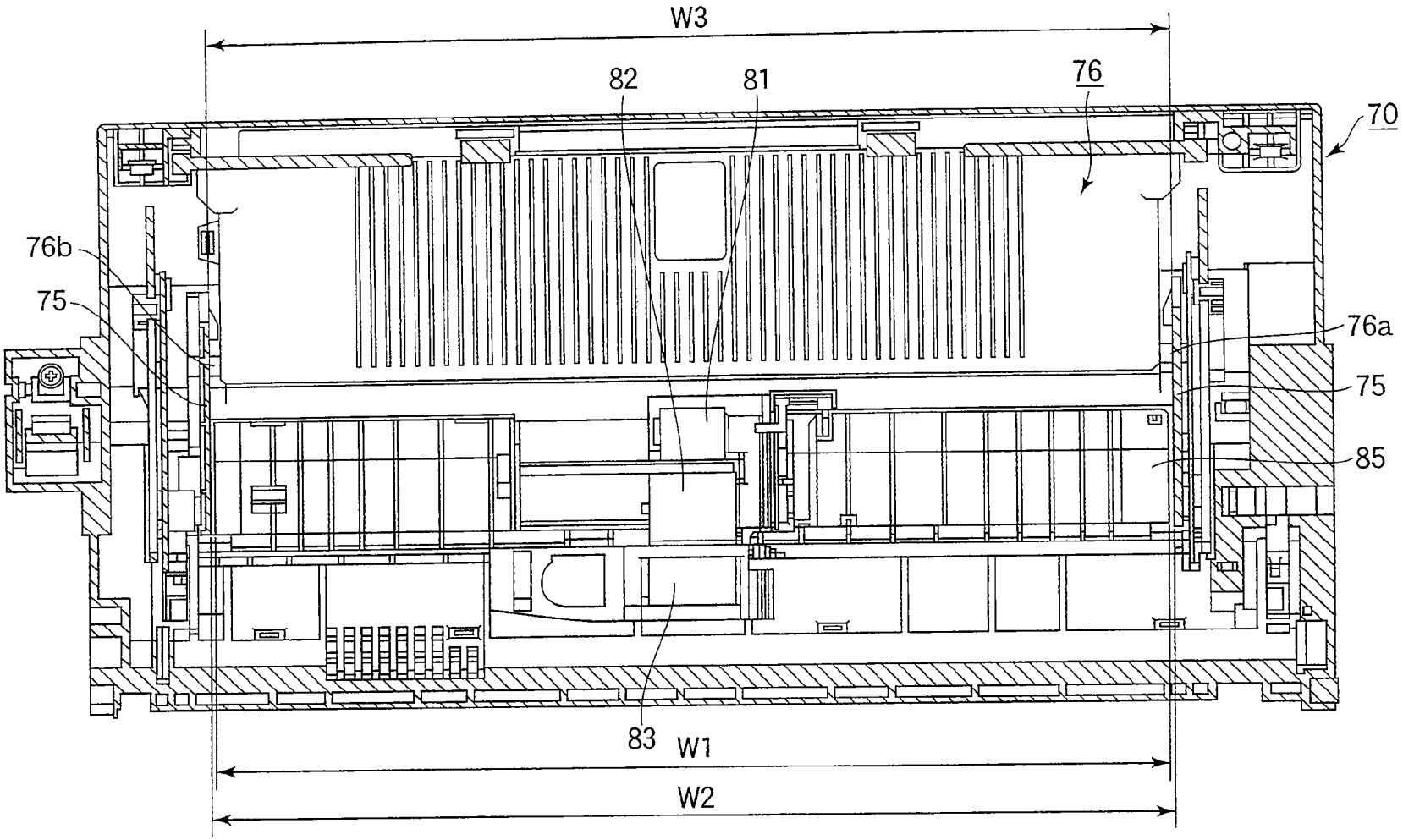
FIG. 16 illustrates the positional relationship among the feeder frame, side guides, and an auxiliary tray according to a third embodiment when a paper tray is attached to the apparatus.

FIG. 16 illustrates the positional relation among a feeder frame 85, side guides 75, and an auxiliary support section when a paper tray 70 is accommodated in the image forming apparatus.

The paper tray 70 includes opposing side guides 75 that limit the side edges of a stack of paper 12 (FIG. 1). Each of the side guides 75 has a rack, not shown, which is in mesh with a common pinion, not shown, at a middle of the paper tray 70 in the direction of width of the paper 12. Thus, the movement of one of the side guides 75 is transmitted to the other of the side guides 75 through a rack-and-pinion mechanism in such a way that the side guides 75 are moved in opposite directions. This allows the side guides 75 to guide the paper 12 having various widths.

The feeder frame 85 is located over a transport path of the paper 12 and extends across the width of the transport path. The feeder frame 85 guides the paper 12. Thus, a span W1 of the feeder frame 85 is selected to be larger than a maximum width of the paper 12 so that the paper 12 having the maximum width or a width less than the maximum width can be guided properly. This requires that when the paper tray 70 is closed, the side guides 75 are positioned outside the span W1, thereby preventing the feeder frame 85 from interfering with the guides 75. For this purpose, the first auxiliary support 76 has projections 76*a* and 76*b*. Thus, the span W1 and the distance W2 between the side guides 75 are related such that W2>W1.

As described above, the side guides 75 can be displaced outwardly of the feeder frame 85. Therefore, when the paper tray 70 is closed, the side guides 75 and the feeder frame 85 are prevented from interfering with each other.

When the side guides 75 guide the paper 12 having a relatively small width during printing, the distance W2 is relatively short, probably shorter than W1. However, the feeder frame 85 is designed to span across W1 sufficient for guiding the paper 12 having a maximum width. Therefore, it is required to ensure that W2>W1 before the paper tray 70 is closed into the image forming apparatus. For this purpose, the first auxiliary support 76 is provided with projections 76*a* and 76*b* on its lateral ends so that the distance between free ends of the projections 76*a* and 76*b* is longer than W1. When the auxiliary support 76 is folded onto the paper tray 70, the side guides 75 are positioned such that the side guides 75 abut the projections 76*a* and 76*b*, thereby ensuring that the distance W2>W1 before the paper tray 70 is closed into the image forming apparatus.

In other words, the width W1 of the feeder frame 85 and the distance W3 between the projections 76*a* and 76*b* are related such that W3>W1.

Fourth Embodiment

In the first embodiment, the medium feeding section 80 includes a second medium detector 89 that detects the presence or absence of the paper 12 and a position detector that detects the position of the pickup roller 81. In other words, the first embodiment requires two sensors.

A fourth embodiment requires a less number of sensors. Elements similar to those of the first to third embodiments have been given the same reference numerals and the description thereof is omitted.

Figure 17:
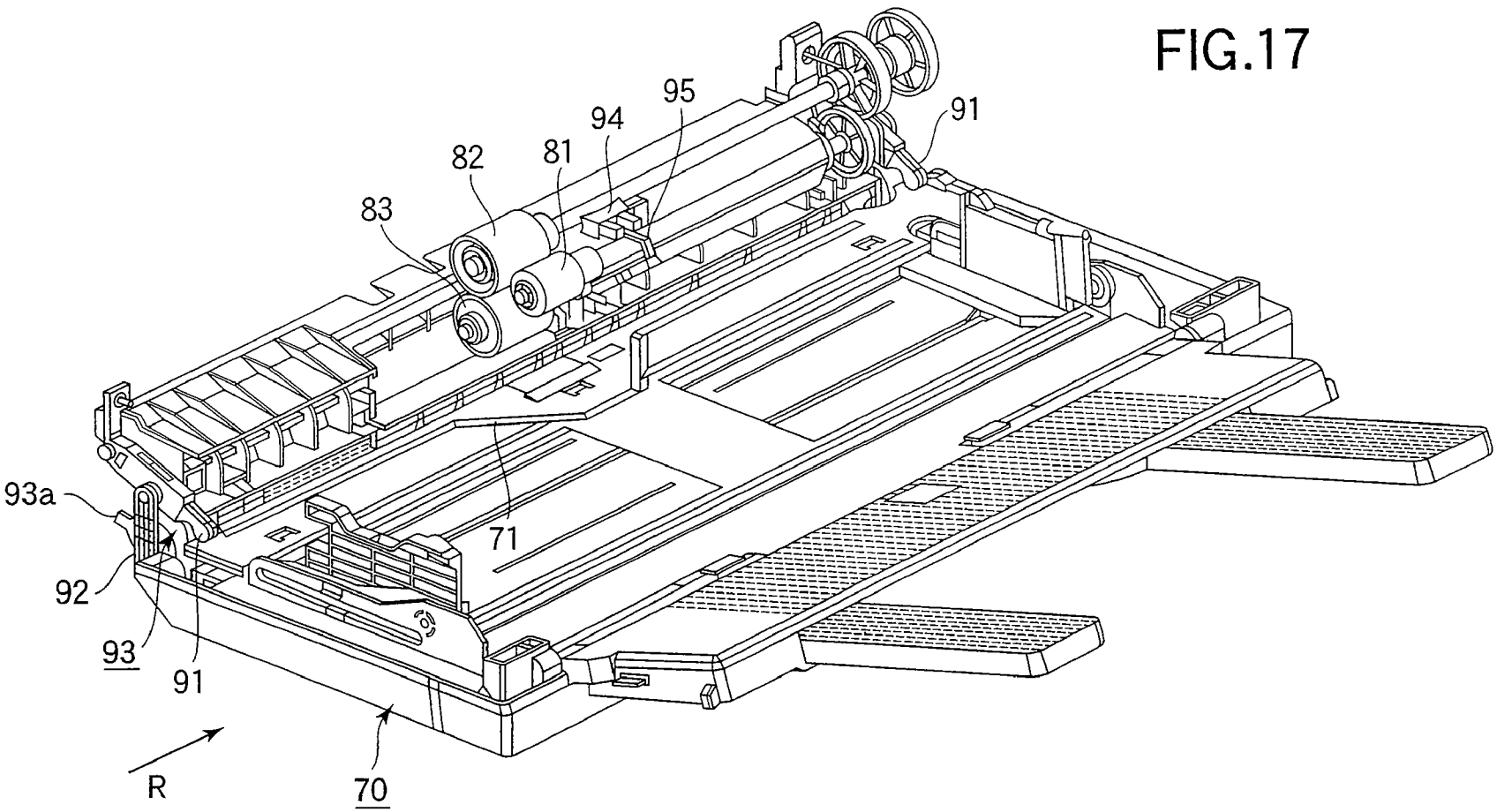
FIG. 17 is a perspective view of a medium-supporting platform according to a fourth embodiment when it is at its lower position.
Figure 18:
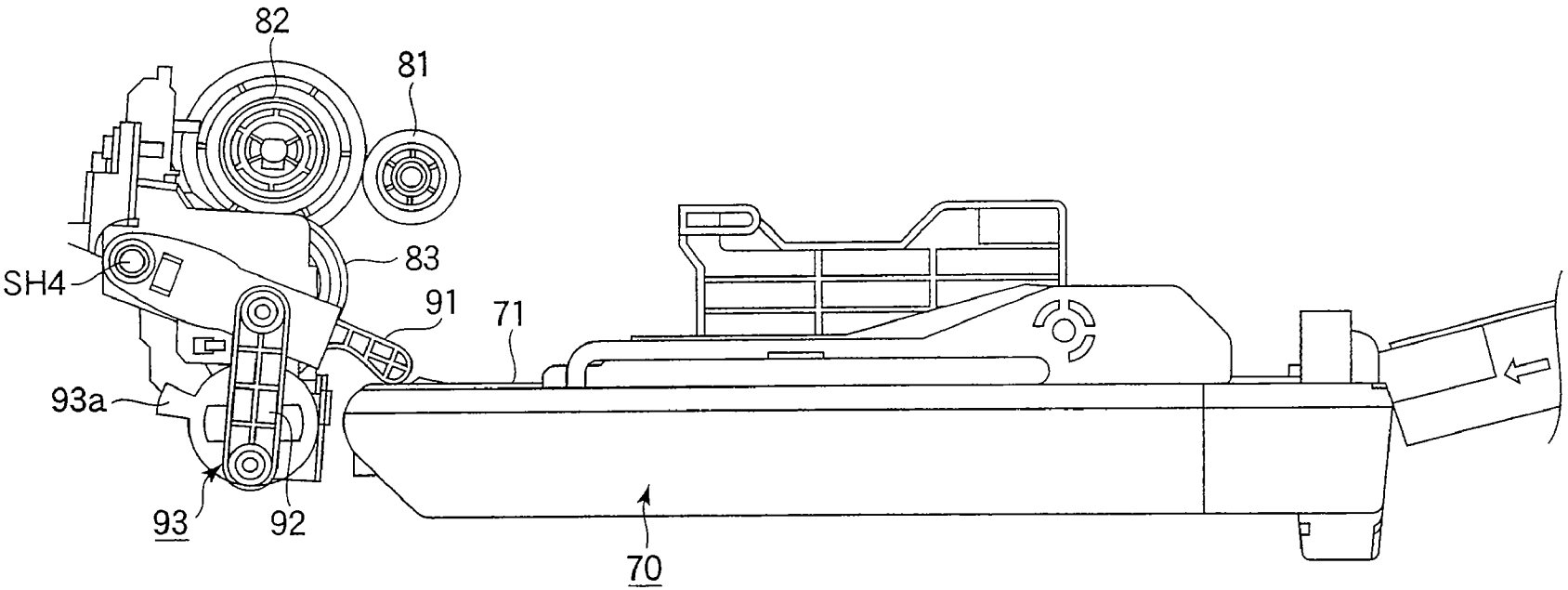
FIG. 18 is a side view of FIG. 17 as seen in a direction shown by arrow R in FIG. 17.
Figure 19:
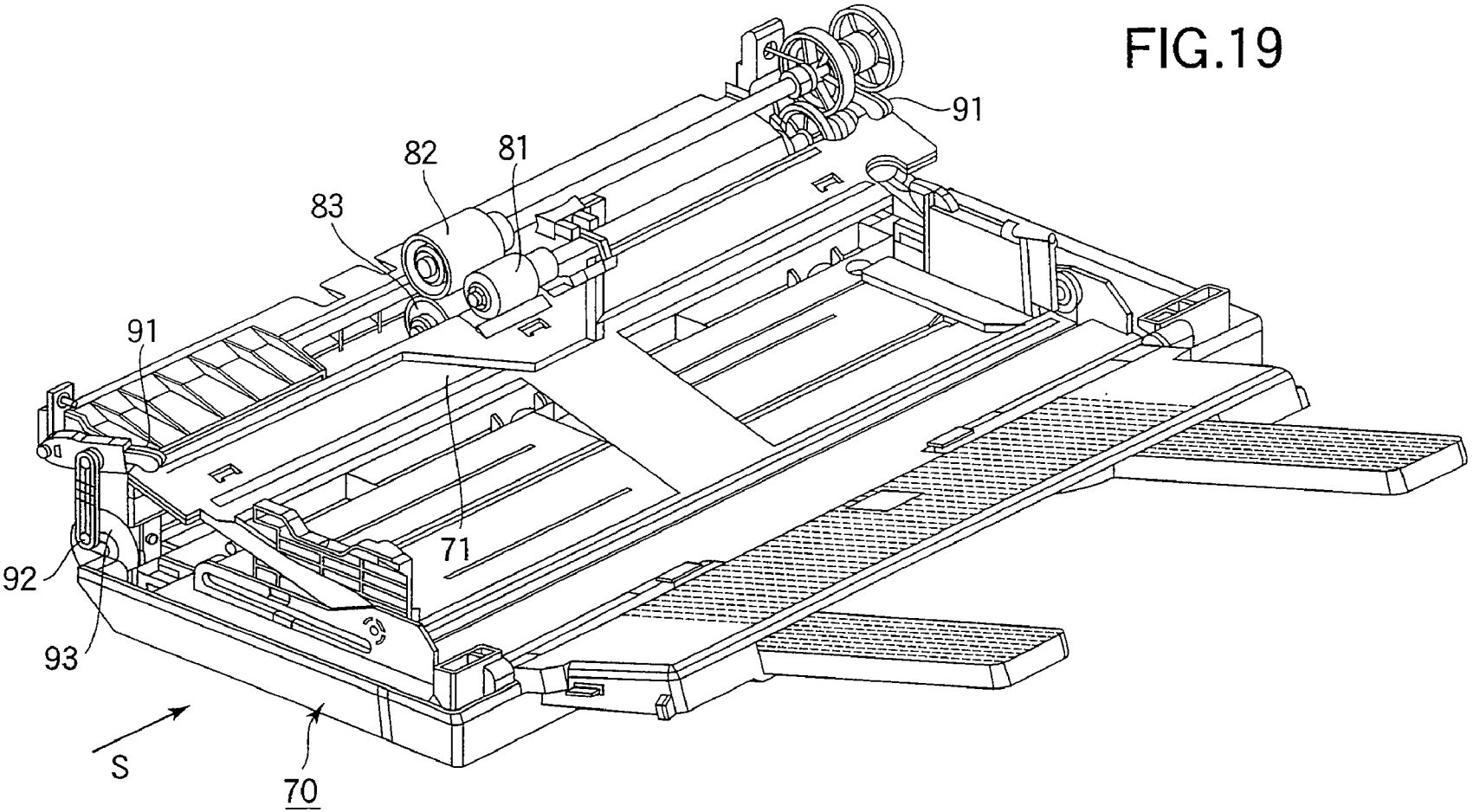
FIG. 19 is a perspective view of the medium-supporting platform when it is at its upper position.
Figure 20:
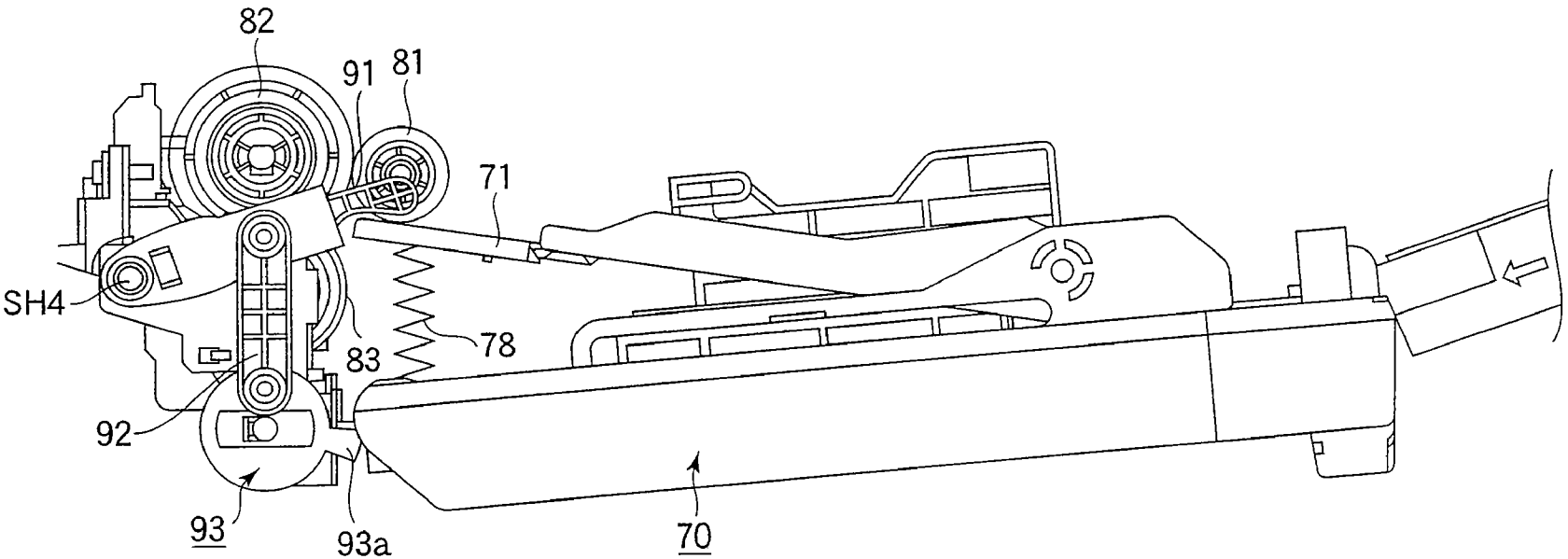
FIG. 20 is a side view of FIG. 19 as seen in a direction shown by arrow S in FIG. 19.

FIG. 17 is a perspective view of a medium-supporting platform 71 when it is at its lower position. FIG. 18 is a side view of FIG. 17 as seen in a direction shown by arrow R in FIG. 17. FIG. 19 is a perspective view of the medium-supporting platform 71 when it is at its upper position. FIG. 20 is a side view of FIG. 19 as seen in a direction shown by arrow S in FIG. 17.

Referring to FIG. 20, a paper tray 70 includes a spring 78 located under a forward end portion of a medium-supporting platform 71. The spring 78 urges the medium-supporting platform 71 upward so that the forward end portion of the medium-supporting platform 71 moves upward into contact engagement with the pickup roller 81. An arm 91 is pivotal about a shaft SH4 mounted on the main frame 87 (FIG. 3). The arm 91 abuts the medium-supporting platform 71 outside of an area in which the paper 12 passes, and then abuts the medium-supporting platform 71, thereby preventing the medium-supporting platform 71 from raising any further.

Referring to FIGS. 18 and 20, a link 92 is pivotally coupled to a gear 93 at its one end and to a mid portion of the arm 91 at its other end. In other words, the arm 91 and the gear 93 are operatively coupled through the link 92. The gear 93 has a projection 93*a*, which extends from a circumference of the gear 93 outwardly in a radial direction. The projection 93*a* is used to detect when the medium-supporting platform 71 is at its lower position, i.e., home position. A lower position sensor, not shown, is located in the vicinity of the circumference of the gear 93 and detects the projection 93*a*.

The gear 93 is coupled to a motor, not shown, that drives the medium-supporting platform 71 to raise and lower. The controller drives the motor to rotate the gear 93, thereby raising and lowering the medium-supporting platform 71.

The spring 78, arm 91, link 92, gear 93 cooperate to control the height of the forward end of the medium-supporting platform 71. A sensor 94 (FIG. 21) takes the form of a photo sensor similar to a photo sensor 301 in FIG. 38, and detects the height of the paper 12 on the medium-supporting platform 71. The sensor 94 also detects the presence or absence of the paper 12. A lever 95 (FIGS. 17 and 21) is pivotal about a pin 95*a* and cooperates with the sensor 94 to detect the presence or absence of the paper 12 as described later in detail.

The feeder frame 85 is pivotally mounted on the image forming apparatus and supports the pickup frame 84 (FIG. 4) in such a way that the pickup frame 84 can pivot about an axis 82*a* of a feed roller 82. As the paper tray 70 is opened, the urging force of the torsion spring 90 (FIG. 14) causes the pickup roller 81 to move in a direction of the thickness of the stack of paper 12 so that the pickup roller 81 is in pressure contact with the top page of the stack of the paper 12. Alternatively, the pickup roller 81 may be arranged such that the pickup roller 81 presses due to its own weight the top page of the stack of the paper 12. The pickup roller 81, pickup frame 84, and feeder frame 85 form a medium-feeding mechanism.

The operation of the second medium supplying mechanism according to the fourth embodiment will be described.

Figure 21A:
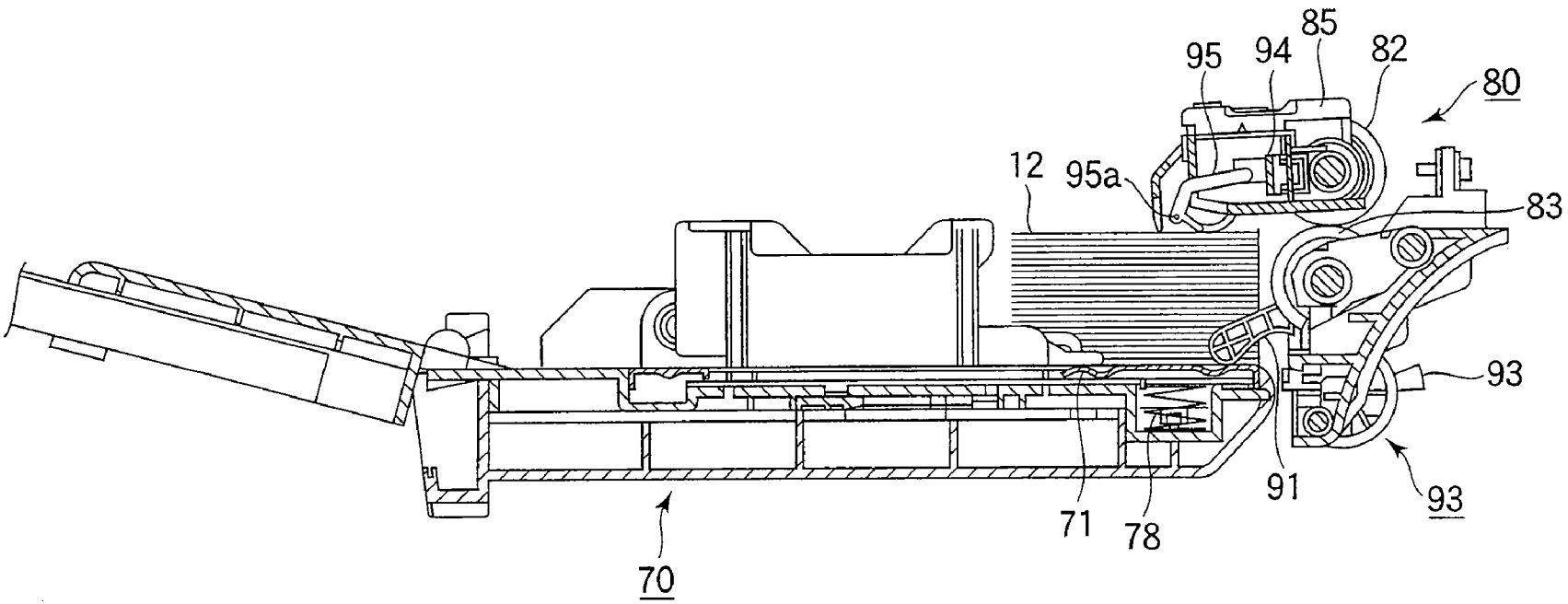
Figure 21B:
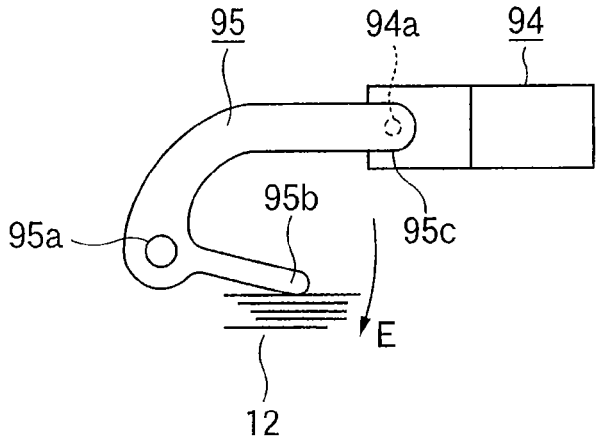
FIG. 21B is an enlarged view illustrating the positional relation between a lever and a sensor.
Figure 23B:
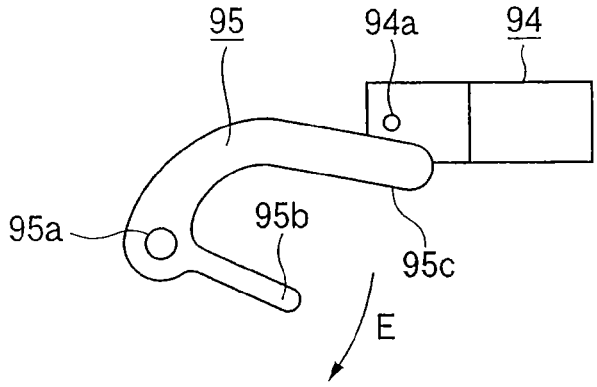
FIG. 23B is an enlarged view illustrating the relation between the lever and sensor.
Figure 21C:
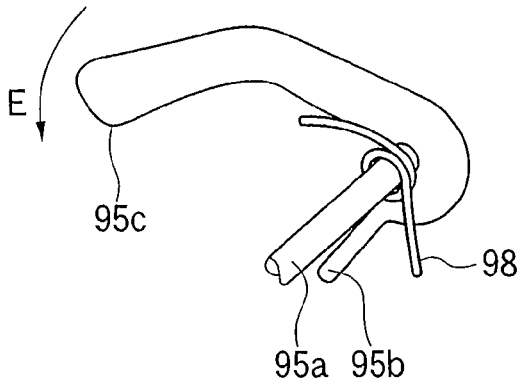
FIG. 21C illustrates a torsion spring.

FIG. 21B is a partially cross-sectional view of the sensor 94 according to the fourth embodiment when the sensor 94 is ON. FIG. 21A illustrates the positional relation between the sensor 94 and the lever 95. FIG. 21C illustrates a torsion spring 98. FIG. 23B is a partially cross-sectional view of the sensor 94 when it is OFF.

Referring to FIGS. 21A and 21B, the sensor 94 and lever 95 are mounted on the feeder frame 85. The lever 95 is supported on the feeder frame 85 in such a way that the lever 95 is pivotal about a pin 95*a* and the sensor 94 detects the pivotal movement of the lever 95. As shown in FIG. 21C, the torsion spring 98 is mounted on the pin 95*a* to urge the forward end 95*b* of the lever 95 in a direction shown by arrow E against the paper 12. Thus, the forward end portion 95*b* is in pressure contact with the top page of the stack of the paper 12.

Referring to FIG. 21B, when the rearward end portion of the lever 95 enters a light path 94*a* of the sensor 94 so that the sensor 94 becomes ON, the sensor 94 detects the paper 12 and provides a detection signal to the controller.

Referring to FIG. 23B, when the rearward end portion 95*c* of the lever 95 has exited the light path 94*a* of the sensor 94, the sensor 94 no longer detects the paper 12 and the controller determines that no medium exists in the paper tray 70. In other words, depending on the state of the detection signal, the controller determines whether the paper 12 exists in the paper tray 70.

Referring to FIG. 21A, when a stack of the paper 12 is on the medium-supporting platform 71, if the controller receives a printing-initiating signal, the controller drives the raising-and-lowering motor to rotate the link gear 93, thereby raising the arm 91. As a result, the urging force of the spring 78 raises the medium supporting platform 71 while the medium supporting platform 71 is in contact with the arm 91. Likewise, the paper 12 on the medium supporting platform 71 is also raised, so that the forward end portion of the lever 95 moves into contact engagement with the top of the stack of the paper 12. Then, the medium-supporting platform 71 continues to be raised until the rearward end portion of the lever 95 enters the light path 94*a* of the sensor 94 to make the sensor 94 ON. At this moment, the controller determines that the reliable feeding of the paper 12 can now be performed, and causes the raising-and-lowering motor to stop raising the medium-supporting platform 71.

Then, the controller initiates printing. The paper 12 placed on the medium-supporting platform 71 is fed on a page-by-page basis into the image forming apparatus and the stack of the paper 12 becomes thinner gradually.

Figure 22:
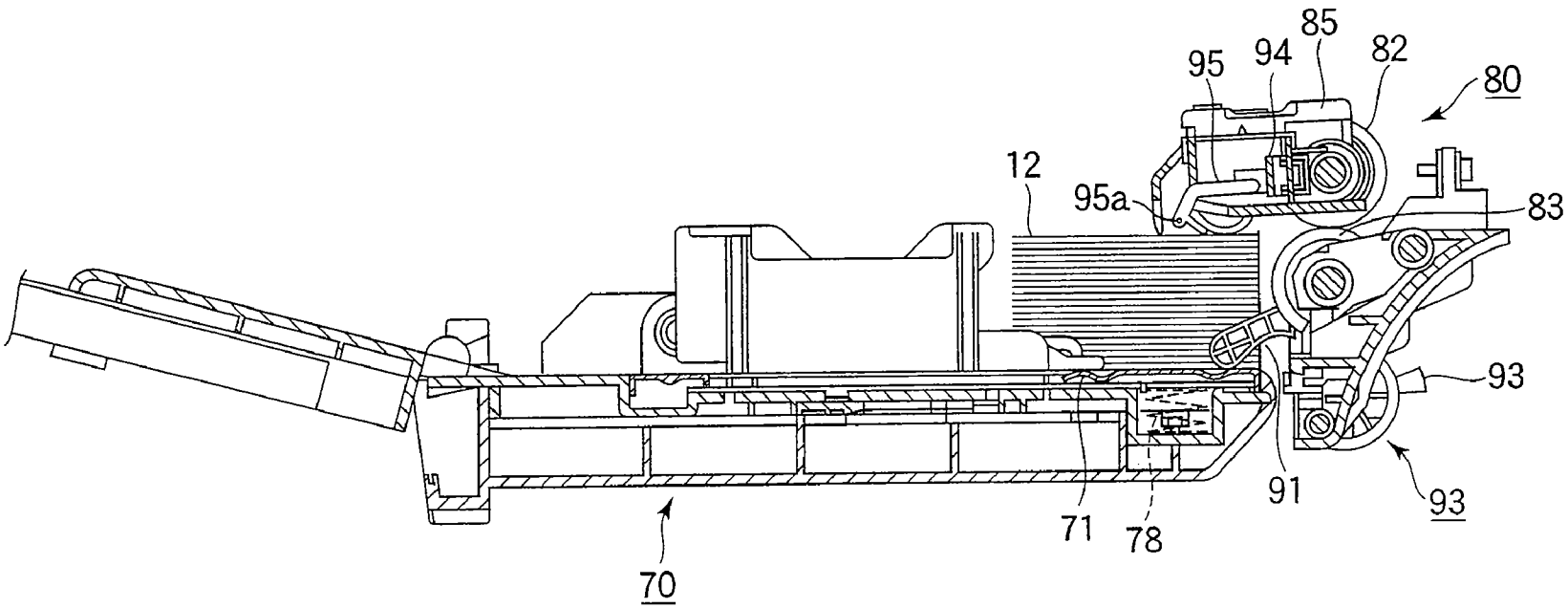
FIG. 22 is a partially cross-sectional view of the sensor when it is OFF.

Referring to FIG. 22, as the pages of the paper 12 are fed into the image forming apparatus, the height of the stack of the paper 12 decreases, so that the rearward end portion of the lever exits the light path 94*a*. Once the rearward end portion of the lever exits the light path 94*a*, the controller causes the raising-and-lowering motor to rotate to raise the medium-supporting platform 71, so that the rearward end portion of the lever 95 again the light path 94*a* of the sensor 94 to make the sensor 94 ON.

As a result, the lever 95 continues to be in contact engagement with the top page of the stack of the paper 12 and rotates gradually about the pin 95*a* by the urging force of the torsion spring as the stack of the paper 12. The paper 12 continues to be fed out until the paper 12 in the paper tray 70 is exhausted. When the paper 12 is exhausted, the forward end portion of the lever 95 drops into a hole, not shown, formed in the medium supporting platform 71 so that the rearward end portion of the lever 95 moves out of the light path 94*a* of the sensor 94 to make the sensor OFF and the sensor remains OFF. When the sensor becomes OFF, the controller determines that the stable feeding of the paper 12 is no longer possible, and causes the raising-and-lowering motor to rotate to raise the medium-supporting platform 71. Thus, the sensor 94 and lever 95 cooperate with each other and functions as a medium detector that detects the presence or absence of the paper 12 on the medium supplying platform 71 and a position that detects the height of the stack of the paper 12. The sensor 94 and lever 95 eliminates the two individual sensors required in the first embodiment.

Figure 23A:
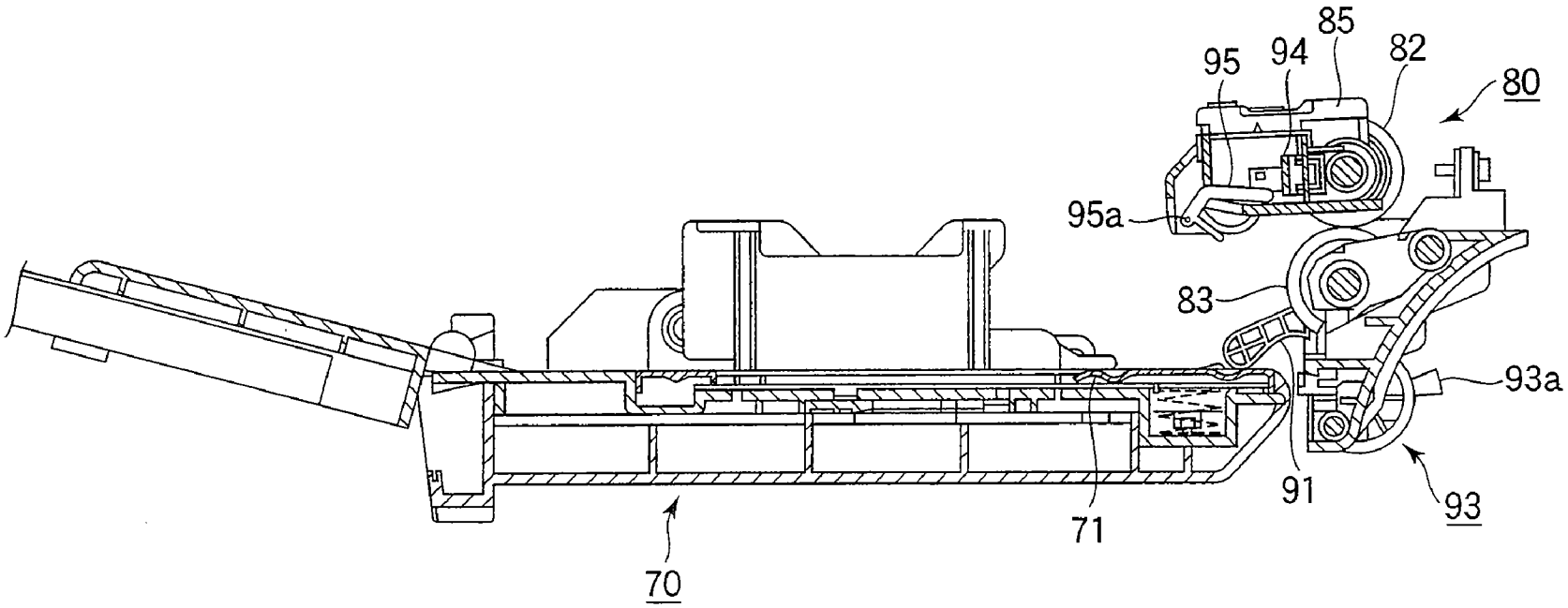
FIG. 23A illustrates the paper tray when there is no paper on it.

FIG. 23A illustrates the paper tray 70 when there is no paper on it. FIG. 23B is an enlarged view illustrating the relation between the lever 95 and sensor 94 shown in FIG. 23A. When all pages of the stack of the paper 12 placed on the medium-supporting platform 71 have been fed out, the forward end of the lever 95 is no longer in contact with the paper 12 and is held at a predetermined position by a limiting member, not shown. Thus, the sensor 94 becomes OFF. The controller causes the raising-and-lowering motor to rotate to raise the medium-supporting platform 71. However, if the sensor 94 continues to be OFF for a predetermined length of time, then the controller determines that no paper 12 exists on the medium-supplying platform 71, and causes the raising-and-lowering motor to rotate to lower the medium-supporting platform 71.

When the lower position sensor detects the projection 93*a* to indicate that the medium-supporting platform 71 is at its lowered position, the controller causes the raising-and-lowering motor to stop. When the paper tray 70 has been dismounted from the apparatus for replacing the paper 12, the sensor 94 continues to be OFF. Thus, the controller may use the output of the sensor 94 to determine whether the paper tray 70 has been dismounted.

With the fourth embodiment, the presence or absence of the paper 12 can be detected by means of the sensor 94, which is a single sensor, disposed on the feeder frame 85. This configuration reduces the number of components, manufacturing cost, and overall size of the medium-supplying apparatus.

The raising-and-lowering motor for raising and lowering the arm 91 is disposed on the image forming apparatus side, implementing a still smaller overall size of the medium-supplying apparatus.

The sensor 94 and the lever 95 are disposed on the feeder frame 85 in the vicinity of the feed roller 82. This arrangement allows the height of the stack of the paper 12 to be directly detected in the vicinity of the feed roller 82, ensuring reliable detection of the paper 12.

Figure 24:
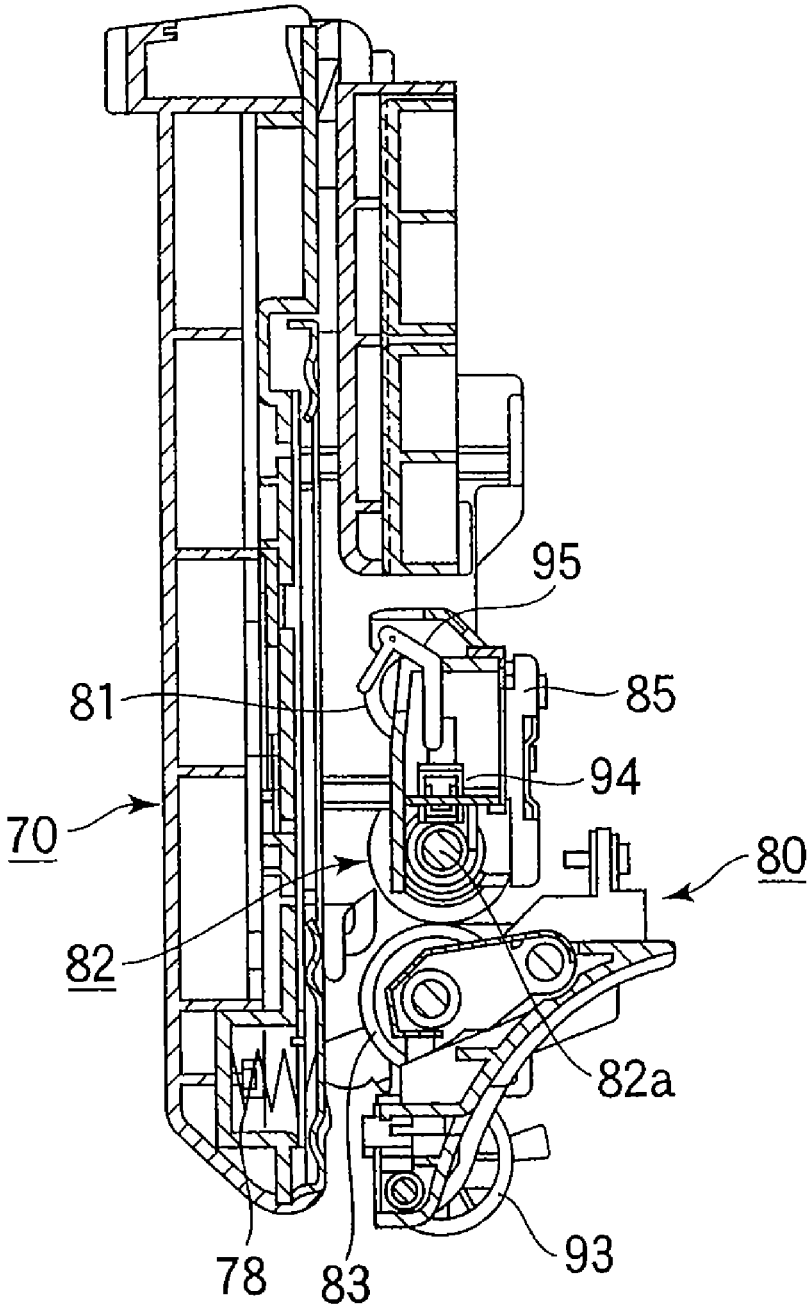
FIG. 24 illustrates the paper tray when it is at its closed position.

FIG. 24 illustrates the paper tray when it is at its closed position. When the paper tray 70 is closed, the feeder frame 85 and pickup roller 81 are pivoted about the axis 82*a* into the main frame 87. At the same time, the sensor 94 and lever 95 are also accommodated into the main frame 87. This is effective in achieving a still smaller overall size of the medium-supplying apparatus.

Fifth Embodiment

A fifth embodiment uses a less number of sensors. Elements similar to those of the first to fourth embodiments have been given the same reference numerals and the description thereof is omitted.

Figure 25:
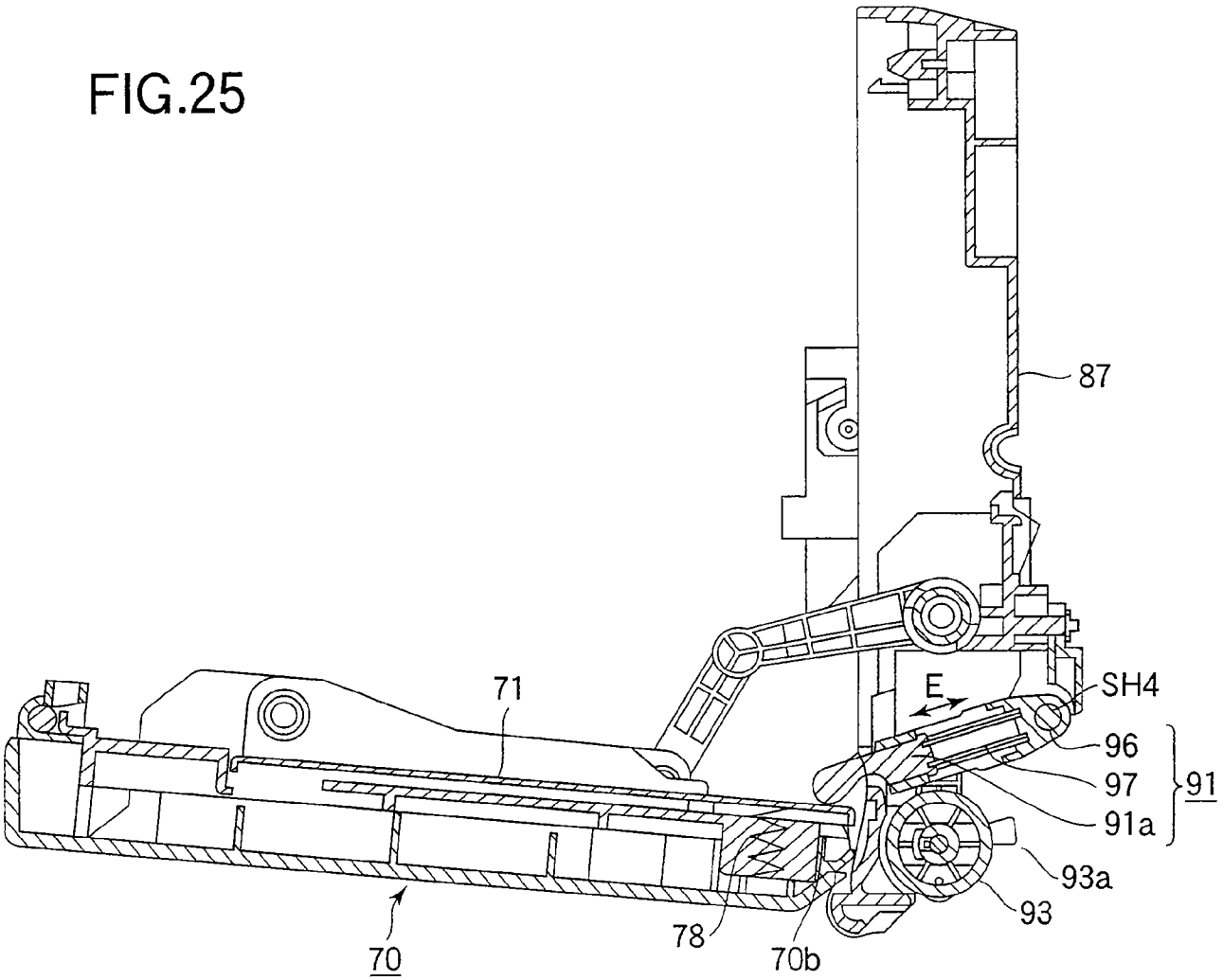
FIG. 25 is a cross-sectional view of a paper tray according to a fifth embodiment when the paper tray is opened.
Figure 26:
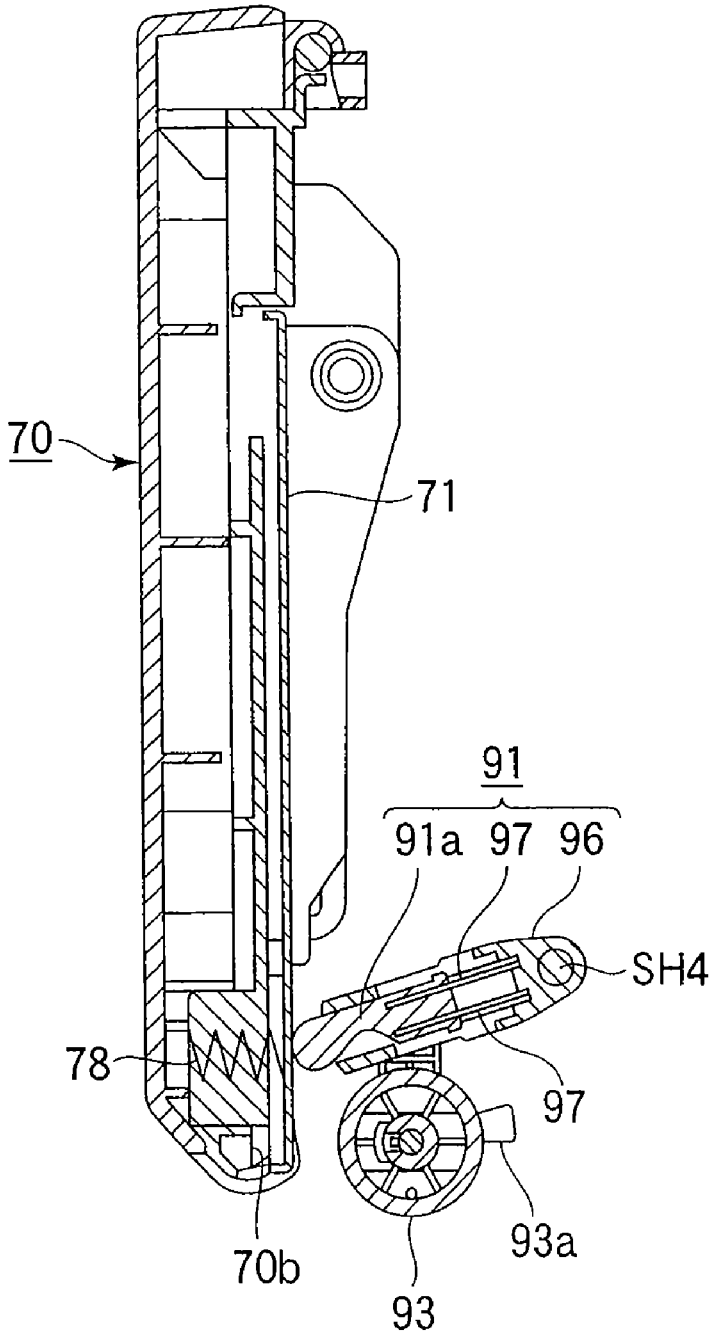
FIG. 26 is a cross-sectional view of the paper tray when the paper tray 70 is closed.

FIG. 25 is a cross-sectional side view of a paper tray 70 according to the fifth embodiment when the paper tray 70 is opened. FIG. 26 is a cross-sectional view of the paper tray 70 when the paper tray 70 is closed.

Just as in the fourth embodiment in FIG. 20, a link, not shown, is pivotally coupled to a gear 93 at its one end and to a mid portion of the arm 91 at its other end. In other words, the arm 91 and the gear 93 are operatively coupled through the link 92. The gear 93 has a projection 93*a*, which extends from a circumference of the gear 93 outwardly in a radial direction. The projection 93*a* is used to detect when the medium-supporting platform 71 is at its lower position, i.e., home position. A lower position sensor, not shown, is located in the vicinity of the circumference of the gear 93 and detects the projection 93*a*.

Referring to FIGS. 25 and 26, an arm 91 includes an arm holder 96, an arm body 91*a*, and a spring 97. The arm holder 96 is pivotal about a shaft SH4. The arm body 91*a* is received in the arm holder 96 and is slidable back and forth in a direction shown by arrow E. The spring 97 urges the arm body 91*a* against a medium-supporting platform 71.

Because the arm body 91*a* makes a small angle with the medium-supporting platform 71, so that the medium-supporting platform 71 exerts a small force on the arm body 91*a* in a direction in which the arm body can slide in the arm holder. Thus, the arm body 91*a* is not pushed into the arm holder 96.

When the paper tray 70 is moved from its open position in FIG. 25 to its closed position in FIG. 26, the medium-supporting platform 71 applies a force to the arm body 91*a*, the force acting in the E direction to push the arm body 91*a* into the arm holder 96. When the force becomes greater than the urging force of the spring 97, the arm body 91*a* is pushed into the arm holder 96 so that the arm 91 contracts against the urging force 11.

When the paper tray 70 is moved from its closed position to its open position, the spring 97 is allowed to expand the arm body 91*a* to project outward from the arm holder 96.

In the fifth embodiment, because the arm 91 can be contracted and expanded in the above-described manner, a shaft 70*b* of the paper tray 70 can be disposed closer to the image forming apparatus accordingly. This configuration implements a small overall size of the apparatus.

In the fifth embodiment, if the paper tray 70 is to hold a large amount of paper 12, e.g., a stack of paper as shown in FIG. 22, the medium-supporting platform 71 is required to support a large amount of paper 12 thereon. For this reason, the medium-supporting platform 71 is formed of a metal material having a sufficient rigidity. However, as pages of the paper 12 are fed in succession, the medium-supporting plate 71 becomes charged due to friction and therefore the paper 12 cannot be fed out smoothly.

To solve this problem, the arm body 91*a* and arm holder 96 are formed of a highly electrically conductive material such as a metal. The arm holder 96 is grounded directly or via the main frame 97, thereby allowing the charges on the medium-supporting platform 71 to move to the ground through the arm body 91*a* and arm holder 96. This eliminates the need for employing any special components that allow the charges to move from the medium-supporting platform 71, thereby reducing the number of components and manufacturing cost of the medium-supplying apparatus.

Moreover, there is no need for providing a charge-flowing path through, for example, the axis 82*a* about which the paper tray 70 is pivoted. Thus, the configuration according to the fifth embodiment makes the shapes of the components simple.

Sixth Embodiment

In the aforementioned embodiments, because the feeder frame 85 and paper tray 70 are coupled through the link 88, when the operator replaces the feed roller 82, the operator has to first take out the retarding roller 83 and then the feed roller 82. Thus, when the operator attaches the feed roller 82 to the axis 82*a* or detaches the feed roller 82 from the axis 82*a*, the pickup roller 81 and feeder frame 85 can be obstacles to the replacement operation of the feed roller 82. As a result, the configuration causes an inefficient replacement operation of the feed roller 82 and may cause an erroneous attachment of the feed roller 82.

Thus, a sixth embodiment provides an efficient replacement operation and accurate attachment of the feed roller 82. Elements similar to those of the first embodiment have been given the same reference numerals and the description thereof is omitted.

Figure 27:
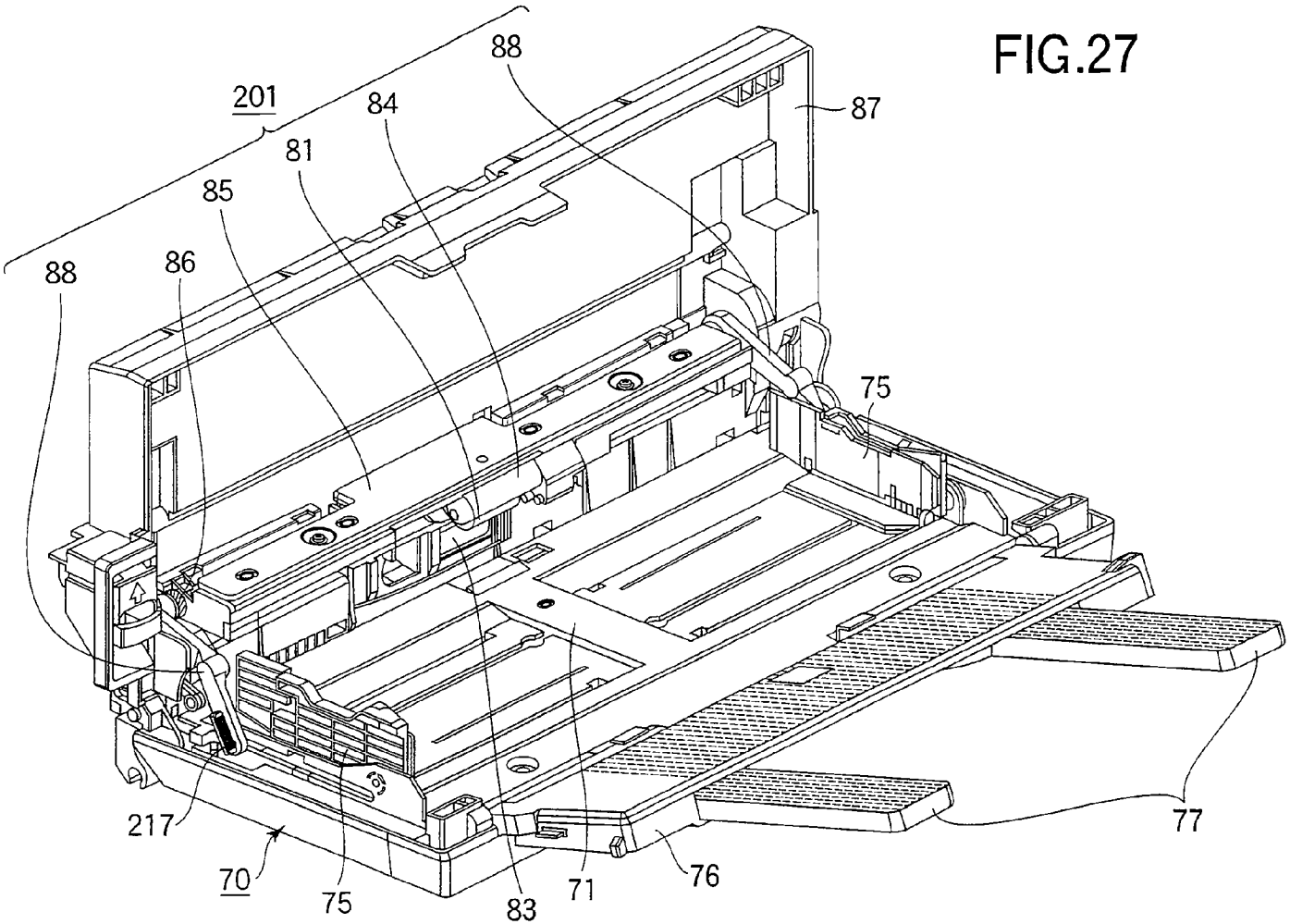
FIG. 27 is a perspective view of a second medium supplying mechanism according to a sixth embodiment.
Figure 28:
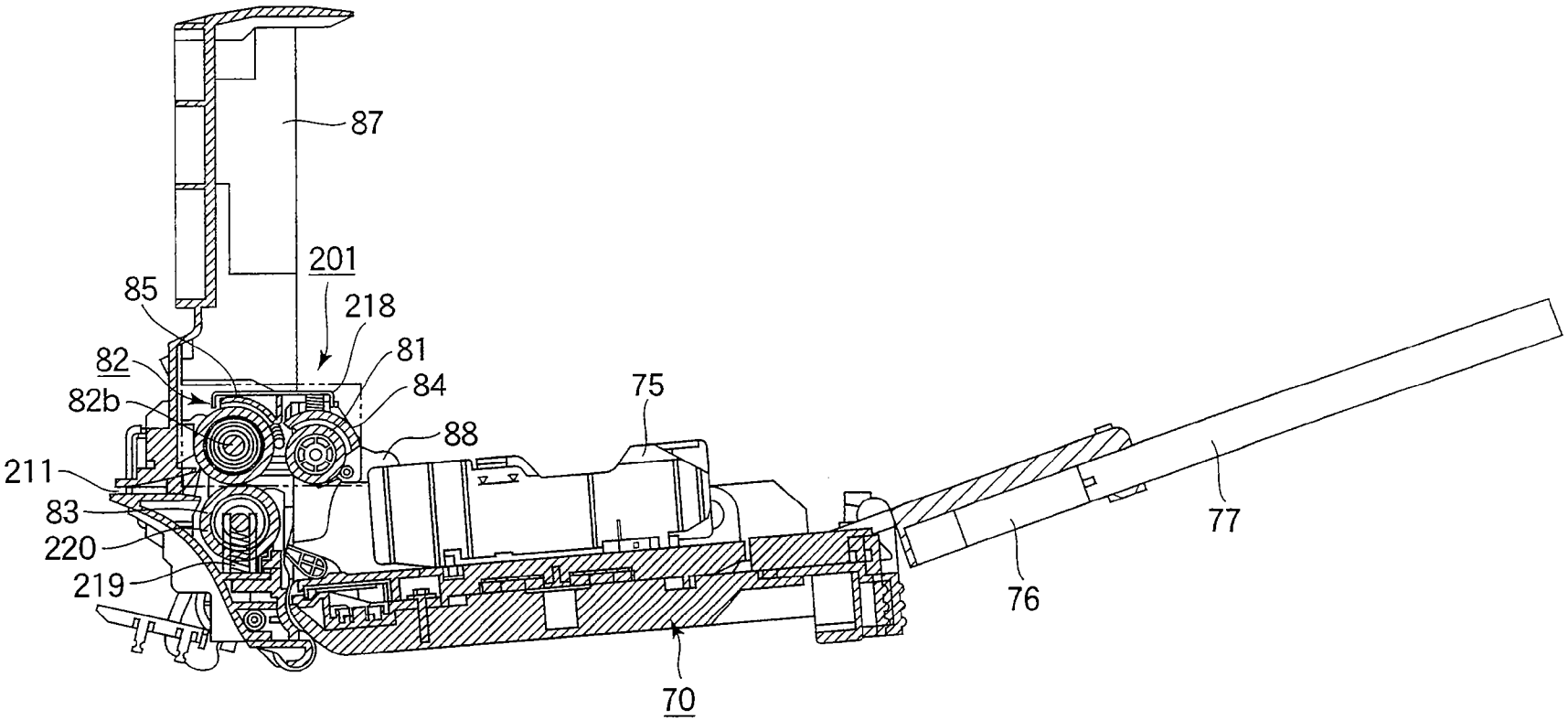
FIG. 28 is a cross-sectional side view of the second medium supplying mechanism of FIG. 27.

FIG. 27 is a perspective view of a second medium supplying mechanism according to the sixth embodiment. FIG. 28 is a cross-sectional side view of the second medium supplying mechanism of FIG. 27.

A feeder unit 201 includes a feeder frame 85, a pickup roller 81, a feed roller 82, a pickup frame 84, a spring 218, and links 88. The feeder unit 201 feeds paper 12 to the image forming apparatus. The pickup roller 81 feeds pages of the paper 12. The feed roller 82 serves as a first discriminator roller. The spring 218 urges the pickup roller 81 against the paper 12 just as shown in FIG. 22. The pickup roller 81, pickup frame 84 and feeder frame 85 form a paper feeding mechanism. A retarding roller 83 is disposed to oppose the feed roller 82 and incorporates a torque limiter therein. The retarding roller 83 serves as a second discriminator and a retarding mechanism. The spring 219 urges the shaft of the retarding roller 83 toward the feed roller 82, so that the retard roller 83 is pressed against the feed roller 82. For this reason, a guide 220 guides the retarding roller 83 in such a way that the retarding roller 83 moves upward and downward in the guide 220.

Figure 29:
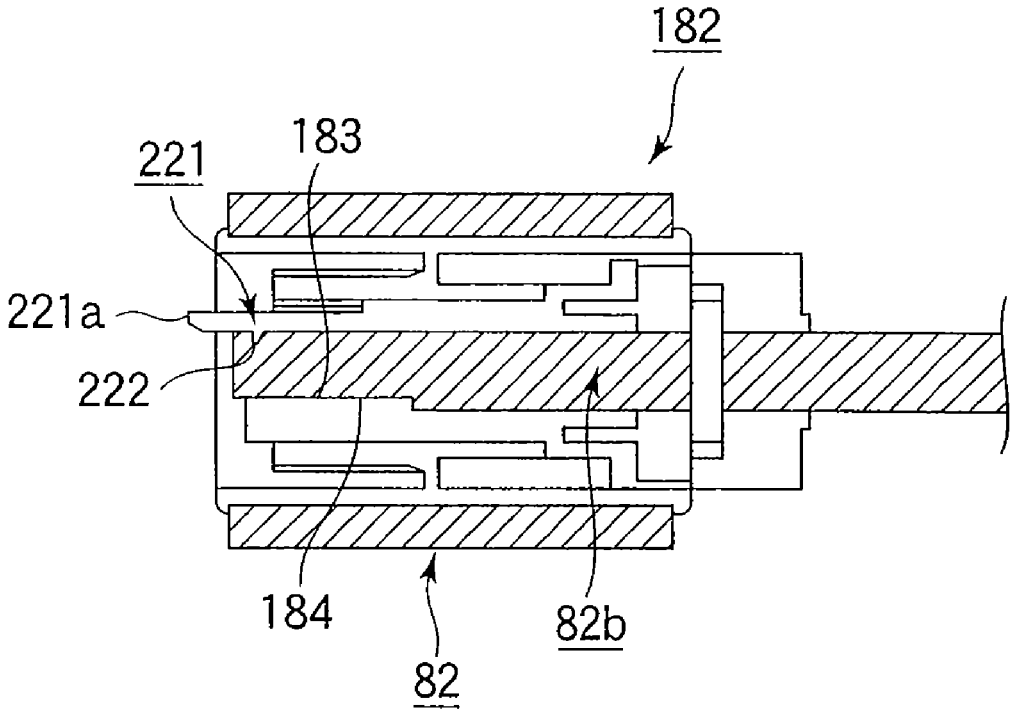
FIG. 29 is a cross-sectional view of a mounting section of a feed roller.

FIG. 29 is a cross-sectional view of a mounting section of the feed roller 82. In order that the feed roller 82 is detachably attached, a resilient projection 221 is formed on an inner surface of a body 182 of the feed roller 82, projecting into a shaft 82*b* to prevent the feed roller 82 from being pulled out. The shaft 82*b* is formed with a groove 222 in its outer circumferential surface, the groove 222 receiving the projection 221 therein. It is sufficient that the groove 222 is formed only in a portion of the shaft 82*b* that opposes the projection 221, but the groove 222 may be formed to extend all around the shaft 82*b* in a direction of circumference of the shaft 82*b*. The projection 221 has an operating portion 221*a* that is operated by the operator when the projection 221 is engaged with or disengaged from the groove 222.

In the sixth embodiment, a shaft 82*b* is cut in a plane parallel to its longitudinal direction to have a flat surface 184, so that the shaft 82*b* has a substantially D-shaped cross section. The body 182 has a flat portion 183 that opposes the flat surface 184 of the shaft 82*b*.

The pickup roller 81 is rotatably supported on the pickup frame 84. The pickup frame 84 is supported on the feeder frame 85 and is pivotal about the shaft 82*b*. The feeder frame 85 is supported on a main frame 87 and is pivotal about the shaft 86 (FIG. 27). The paper 12 is transported in a transport path 211 (FIG. 28).

Figure 30:
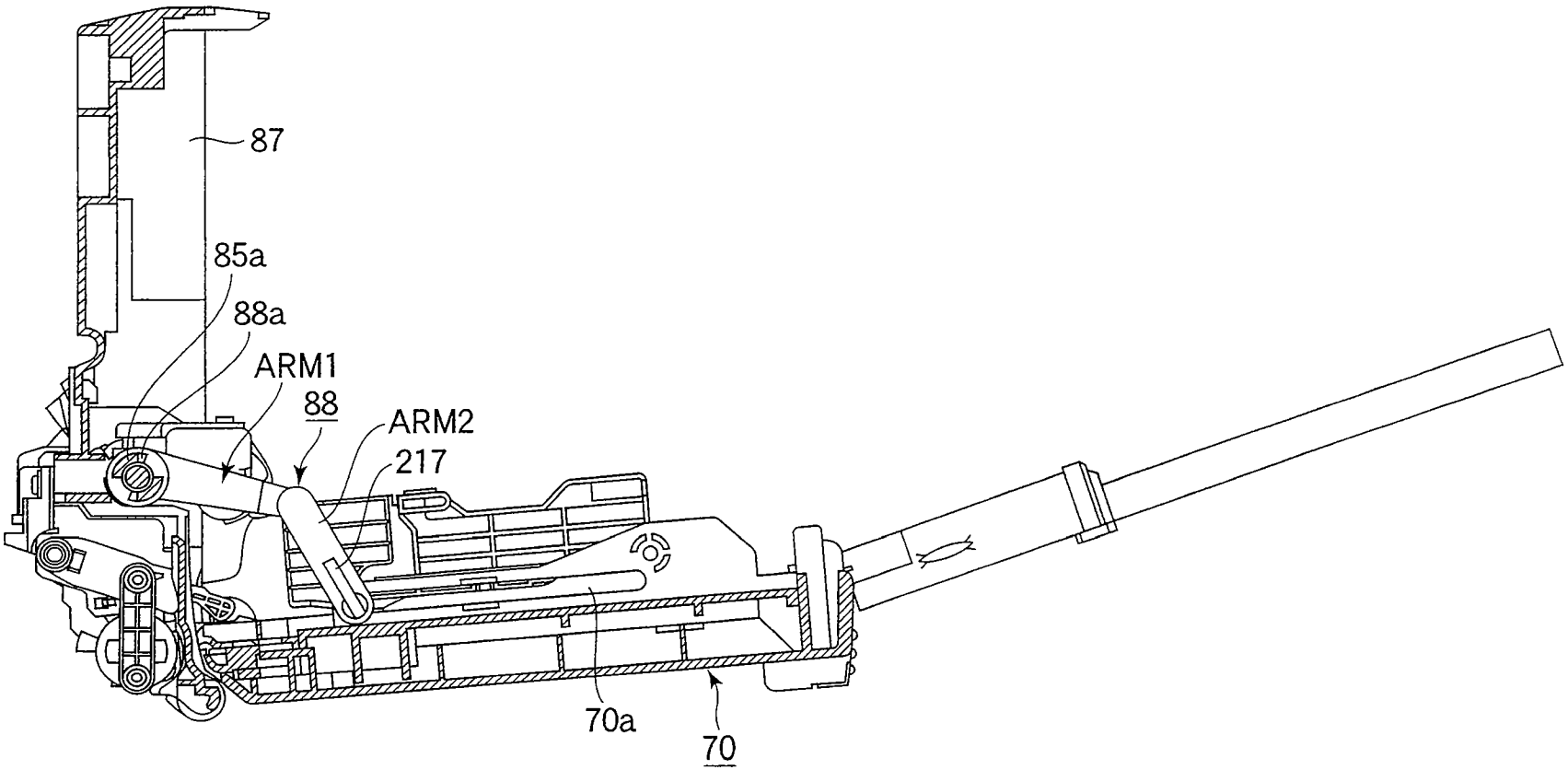
FIG. 30 is a cross-sectional view of the second medium supplying mechanism.

FIG. 30 is a cross-sectional view of the second medium supplying mechanism according to the sixth embodiment.

Referring to FIG. 30, the link 88 includes a first arm ARM 1 and a second arm ARM 2. The link 88 is pivotally coupled to the feeder frame 85 (FIG. 28) at one end portion of the first arm ARM 1 and has a lever 217 provided at one end portion of the second arm ARM 2. A lever 217 serves as a mounting portion for mounting one end portion of a link 88 to a paper tray 70.

The paper tray 70 has an elongated hole 70*a* formed therein. The lever 217 has a boss 217*c* that extends through the hole formed in one end portion of the second arm ARM 2 into the elongated hole 70*a*. The feeder frame 85 has a projection 85*a* formed thereon. The ARM 1 has a hole 88*a* formed therein into which the projection 85*a* is fitted. Thus, the feeder frame 85 and the link 88 are coupled detachably by means of the projection 85*a* and the hole 88*a*.

A description will be given of the operation of the second medium supplying mechanism according to the sixth embodiment when the feed roller 82 is replaced.

Figure 31A:
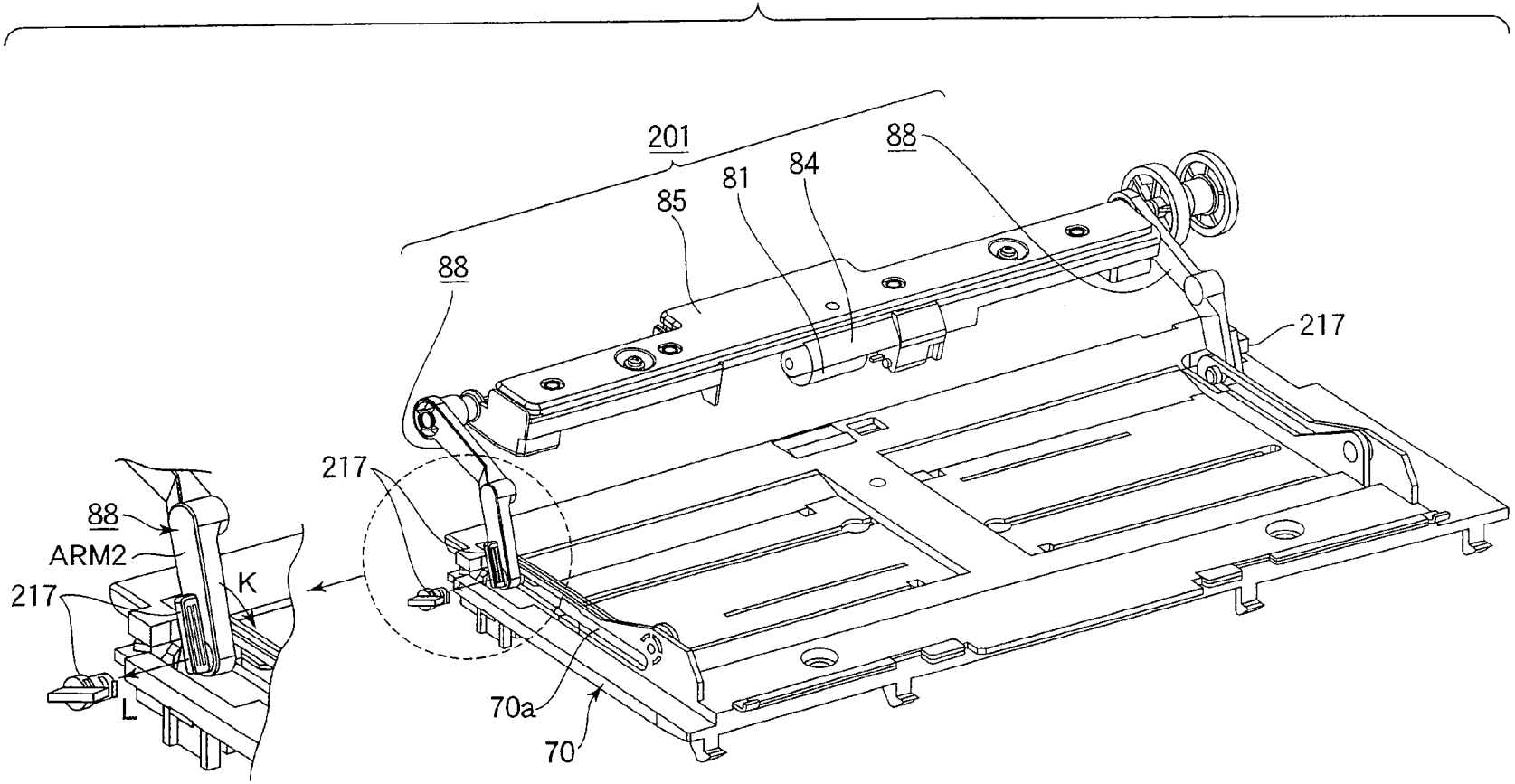
FIG. 31A is a perspective view illustrating the operation of the second medium supplying mechanism.
Figure 31B:
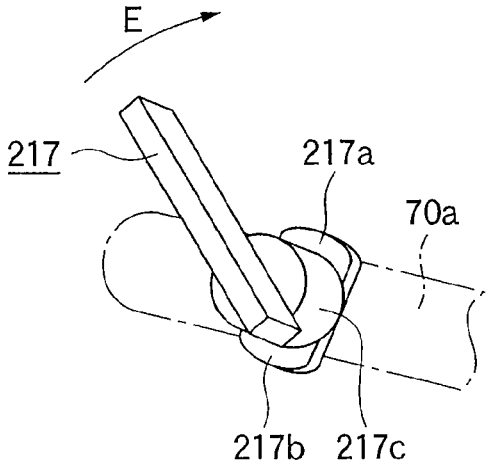
FIG. 31B is a perspective view of the lever when it is at a locked position.
Figure 31C:
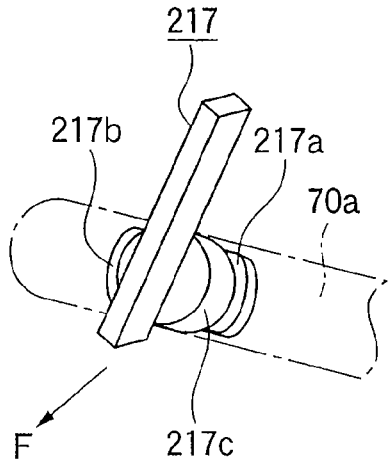
FIG. 31C is a perspective view when it is at an unlocked position.
Figure 31D:
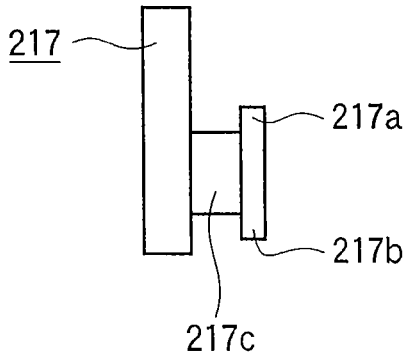
FIG. 31D is a side view of the lever as seen along the elongated hole in FIG. 31B.
Figure 32:
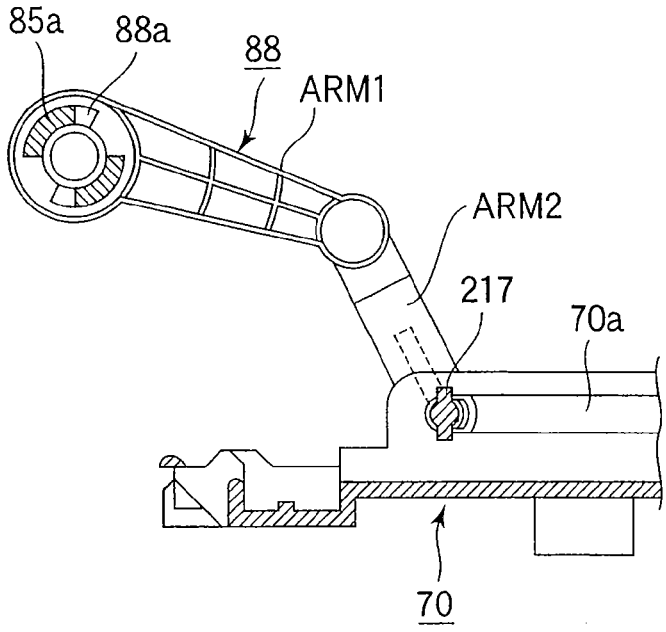
FIGS. 32 and 33 illustrate a lever according to the sixth embodiment.
Figure 33:
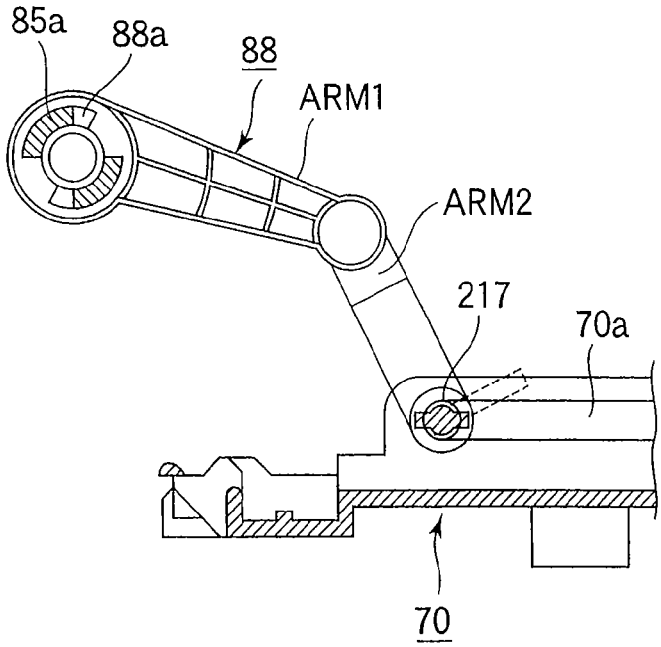

FIG. 31A is a perspective view illustrating the operation of the second medium supplying mechanism. FIG. 31B is a perspective view of the lever 217 when it is at a locked position. FIG. 31C is a perspective view when it is at an unlocked position. FIG. 31D is a side view of the lever 217 as seen in a direction in which the elongated hole 70*a* extends in FIG. 31B. FIG. 32 illustrates the lever 217 with a partial cross sectional view, showing when the lever 217 is at the locked position. FIG. 33 illustrates the lever 217 with a partial cross sectional view when the lever 217 is at the unlocked position.

The lever 217 can be pivoted in a direction shown by arrow E to the locked position in FIG. 32 and in a direction opposite to the E to the unlocked position in FIG. 33. When the paper tray 70 is opened for the image forming section 40 (FIG. 2A) to perform a printing operation, the lever 217 is at the locked position where the projections 217*a* engages the paper tray 70.

As shown in FIG. 31B and FIG. 32, when the feed roller 82 is replaced, the lever 217 is first pivoted in a direction opposite to the E direction by about 90° to the unlocked position. The lever 217 is then pulled in a direction shown by arrow F as shown in FIG. 31C and FIG. 33 to disengage from the link 88. Then, the link 88 is completely pulled out of the paper tray 70.

Figure 34:
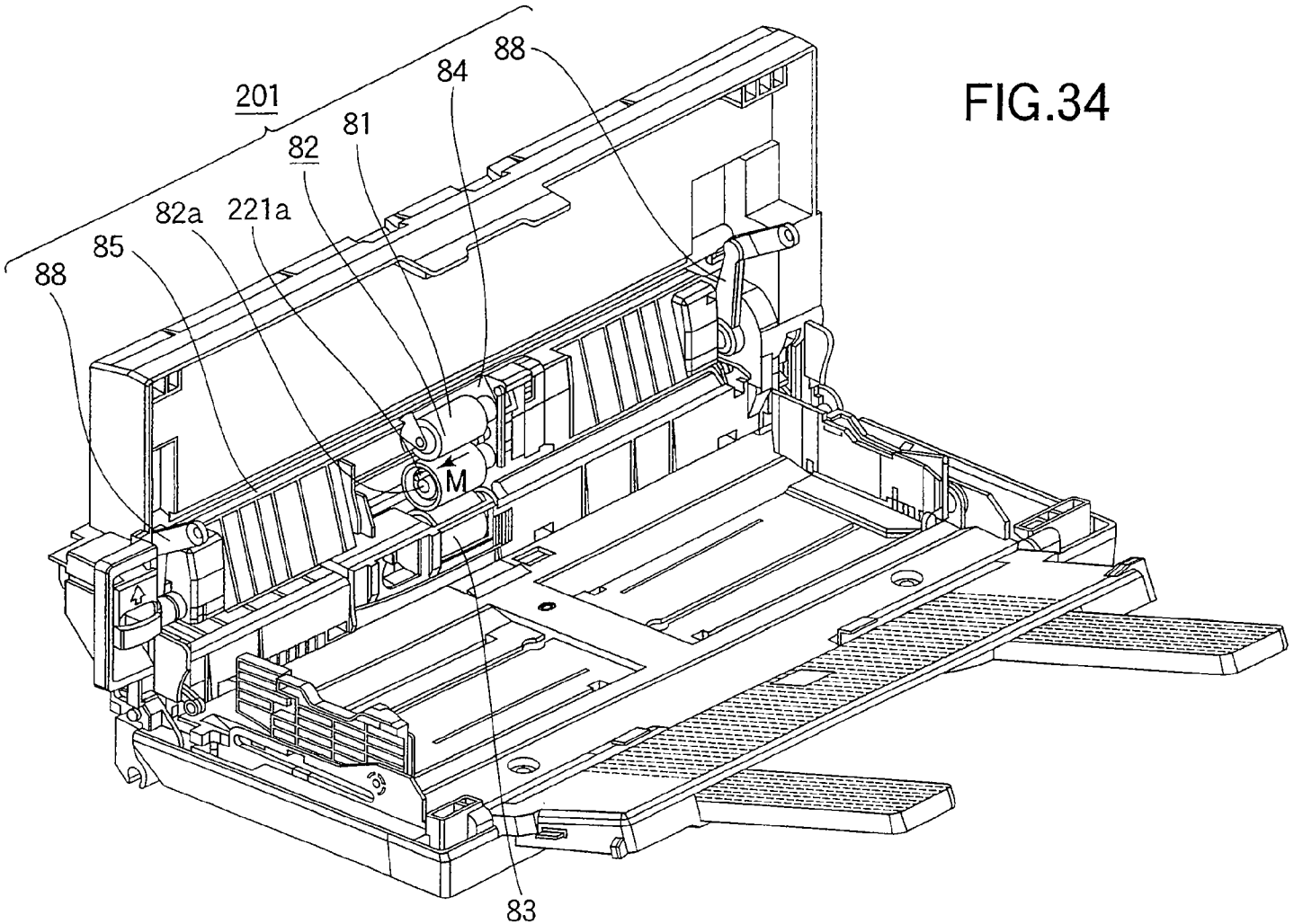
FIG. 34 is a perspective view of the second medium supplying mechanism when the feed roller is replaced.

FIG. 34 is a perspective view of the second medium supplying mechanism when the feed roller is replaced.

Because the link 88 has been disengaged from the paper tray 70, the feeder unit 201 becomes rotatable about the shaft 82*b*. When the feeder unit 201 is pivoted by about 90°, the feed roller 82 can be seen in its entirety as shown in FIG. 34.

At this moment, when the operator holds the operating portion 221*a* and moves it radially outwardly so that the projection 221 (FIG. 29) disengages from the groove 222, the feed roller 82 becomes movable in a direction shown by arrow M in FIG. 34. Thus, the feed roller 82 can be disassembled from the shaft 82*b*. The assembly of the feed roller 82 to the shaft 82*b* can be accomplished by reversing the aforementioned disassembly procedure.

As described above, the link 88 can be disassembled from the paper tray 70. Therefore, the feeder unit 201 can be pivoted to visually recognize the entire feed roller 82 after the lever 217 has been disassembled from the paper tray 70 and the link 88 has been separated from the paper tray 70. Moreover, the operator can replace the feed roller 82 without difficulty and the pickup roller 81 can be cleaned and replaced without difficulty.

Seventh Embodiment

Elements similar to those of the sixth embodiment have been given the same reference numerals and the description thereof is omitted.

Figure 35:
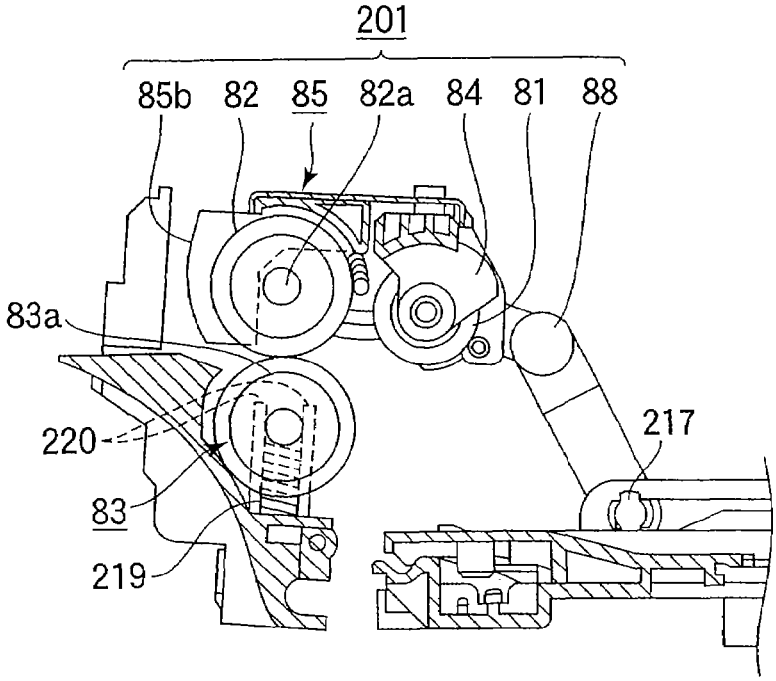
FIGS. 35 and 36 are cross-sectional views of a feeder unit according to a seventh embodiment.
Figure 36:
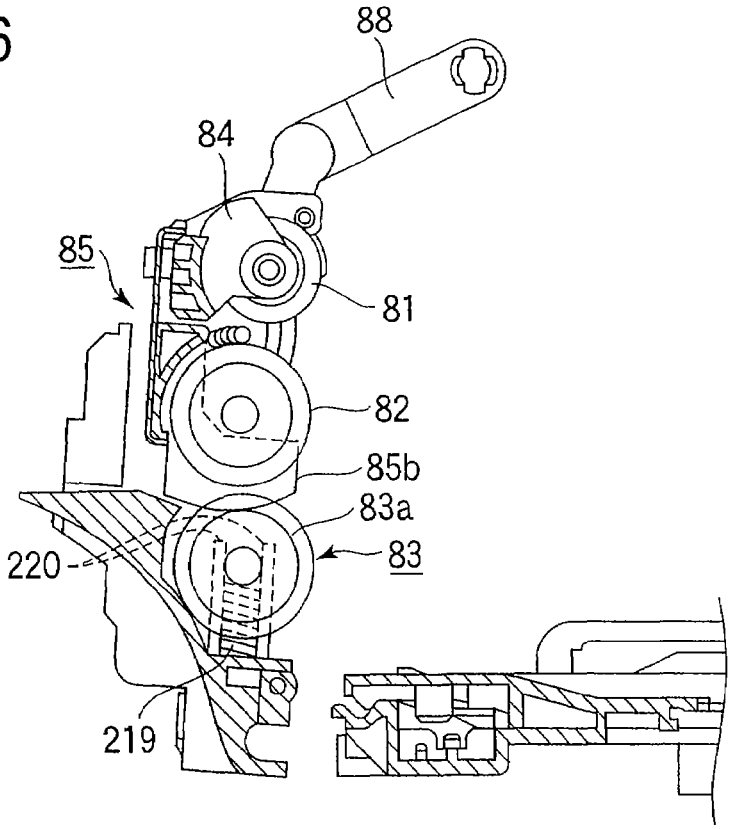

FIGS. 35 and 36 are cross-sectional views of a feeder unit 201 according to a seventh embodiment.

A feed roller 82 serves as a paper feeding mechanism. A retarding roller 83 serves as a paper retarding mechanism. When the feed roller 82 engages with the retarding roller 83, they cooperate to serve as a discriminator. In the seventh embodiment, a cam 85*b* is formed on a feeder frame 85 so that when the feeder unit 201 is pivoted, the cam 85*b* opposes the retarding roller 83. A longitudinal end portion 83*a* of a shaft of the retarding roller 83 serves as a cam follower. When the feeder unit 201 is pivoted, the cam 85*b* moves into contact engagement with the longitudinal end portion 83*a* so that the feed roller 82 and the retarding roller 83 are separated from each other.

In other words, a lever 217 is first rotated to an unlocked position and is then disengaged from the link 88, thereby decoupling the feeder frame 85 from a paper tray 70. Then, the lever 217 is dismounted from a link 88. When the feeder unit 201 is pivoted, the cam 85*b* moves into an abutting engagement with the longitudinal end portion 83*a* of the shaft of the retard roller 83 to push down the retarding roller 83. Thus, the retarding roller 83 moves downward in a guide 220, becoming separate from the feed roller 82.

It is to be noted that because the feed roller 82 is separated from the retarding roller 83, when the feed roller 82 is dismounted from the shaft 82*b*, there is no friction between the feed roller 82 and the retarding roller 83 that would otherwise be developed due to a contact engagement of the feed roller 82 with the retarding roller 83. This facilitates replacement of the feed roller 82. Although the cam 85*b* according to the embodiment is in one piece construction with the feeder frame 85, the cam 85*b* may be a piece separate from the feeder frame 85.

Eighth Embodiment

Elements similar to those of the sixth embodiment have been given the same reference numerals and the description thereof is omitted.

Figure 37:
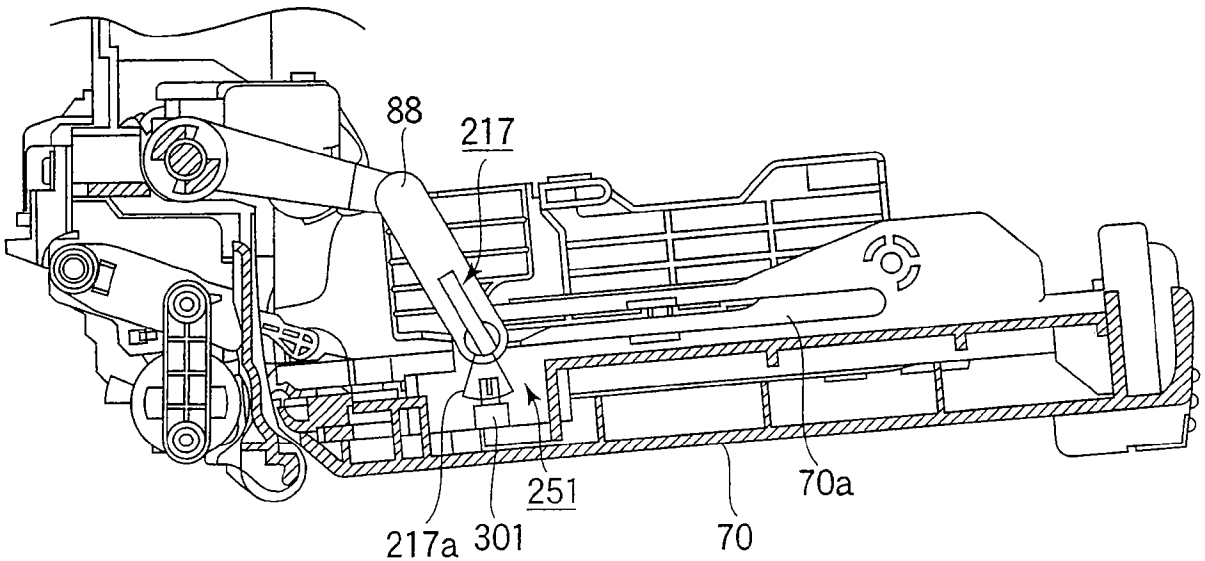
FIGS. 37 and 39 illustrate a second medium supplying mechanism according to an eighth embodiment.
Figure 38:
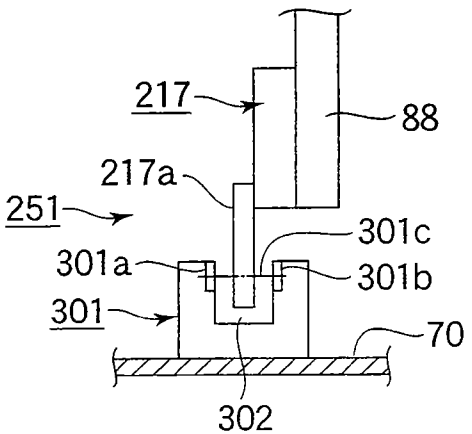
FIGS. 38 and 40 illustrate a lever-detecting section according to the eighth embodiment.
Figure 39:
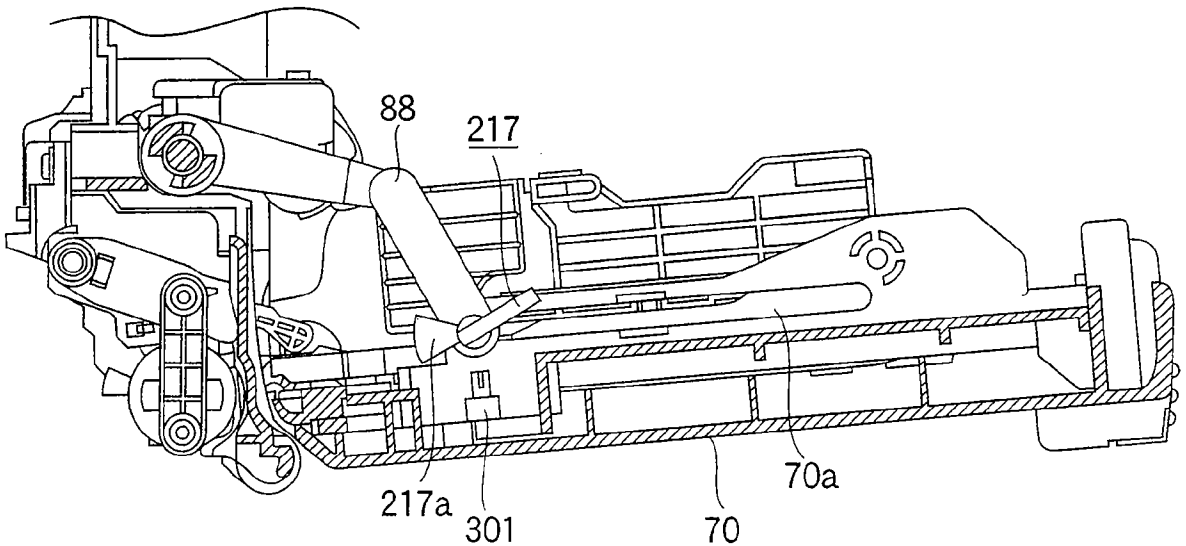
Figure 40:
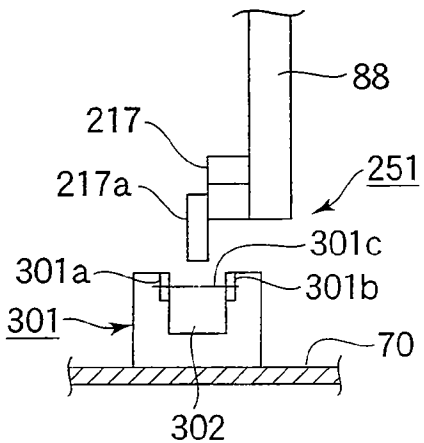

FIGS. 37 and 39 illustrate a second medium supplying mechanism according to an eighth embodiment. FIGS. 38 and 40 illustrate a lever-detecting section according to the eighth embodiment.

Referring to FIGS. 37 and 38, a light blocking section 217*a* is formed on one end portion of a lever 217. A transmission type photo sensor 301 is disposed on a paper tray 70. The light blocking section 217*a* and the photo sensor 301 cooperate to form a lever-detector 251 that detects the state of the lever 217. The photo sensor 301 has a groove 302 formed in its upper surface. A light emitting element 301*a* and a light receiving element 301*b* oppose each other with the groove 302 positioned between them. Thus, as shown in FIG. 38, when the lever 217 is at its locked position where the light blocking section 217*a* is in a light path 301*c* between the light emitting element 301*a* and the light receiving element 301*b*, the photo sensor 301 becomes ON. Referring to FIGS. 39 and 40, when the lever 217 is at its unlocked position where the light blocking section 217*a* is out of the light path 301*c*, the photo sensor 301 becomes OFF. For detecting the state of the lever 217, a micro switch may be used in place of the photo sensor 301.

Then, the controller reads the output of the photo sensor 301. If the photo sensor 301 is ON, then the controller determines that the lever 217 is at the locked position in FIG. 37, and permits printing.

In contrast, if the photo sensor 301 is OFF, then the controller determines that the lever 217 is at the unlocked position in FIG. 39, and prohibits printing.

As described above, because printing is prohibited when the lever 217 is at the unlocked position, the image forming section 40 will not operate when the feed roller 82 is replaced. This configuration improves the reliability of the printer.

Ninth Embodiment

Elements similar to those of the sixth embodiment have been given the same reference numerals and the description thereof is omitted.

Figure 41:
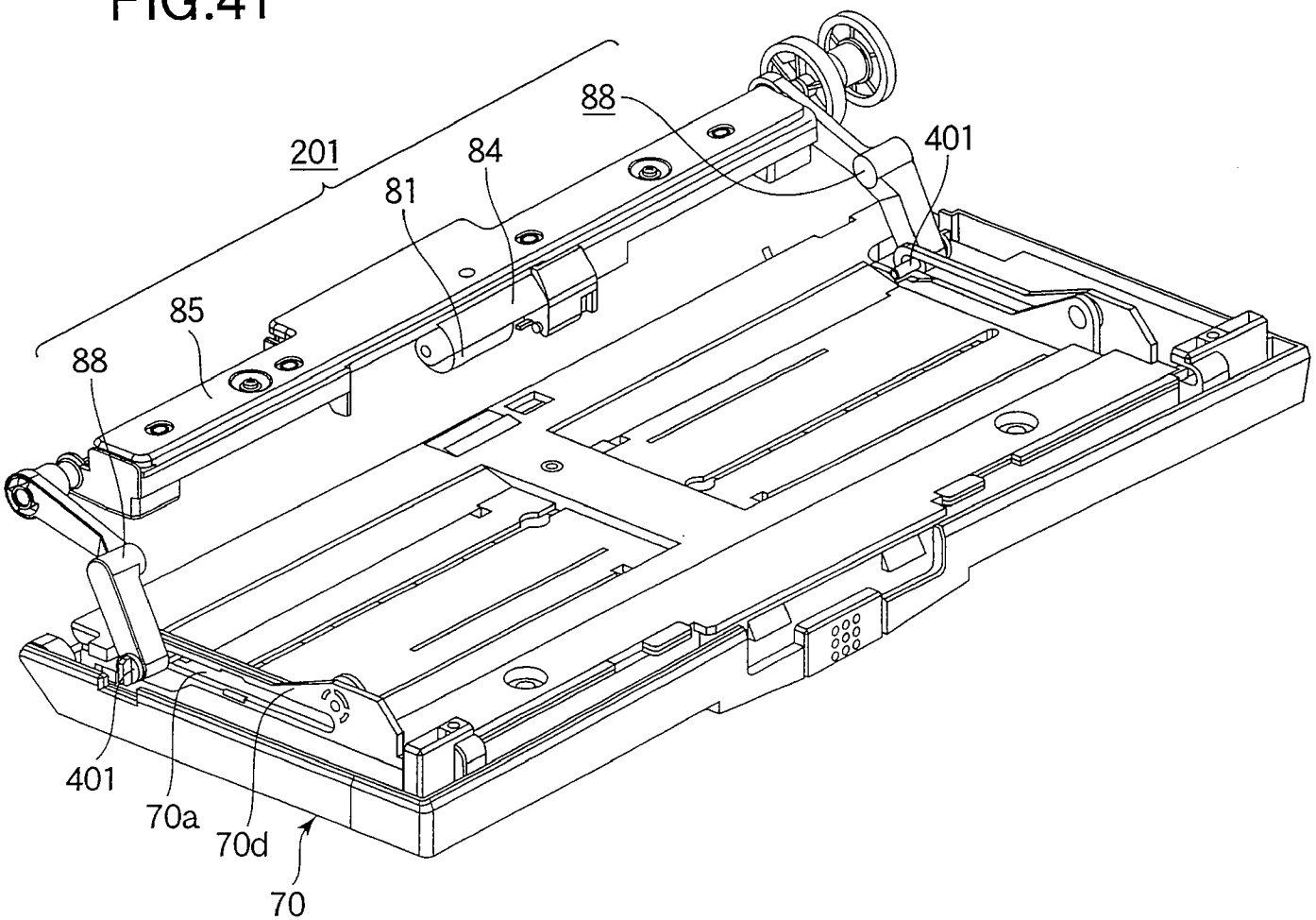
FIG. 41 is a perspective view of a feeder unit and a paper tray according to a ninth embodiment.
Figure 42:
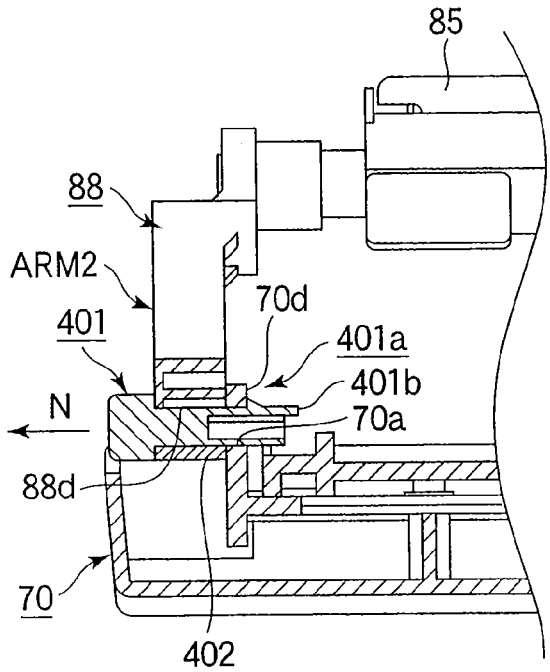
FIGS. 42 and 43 illustrate the operation of a mounting piece according to the ninth embodiment.
Figure 43:
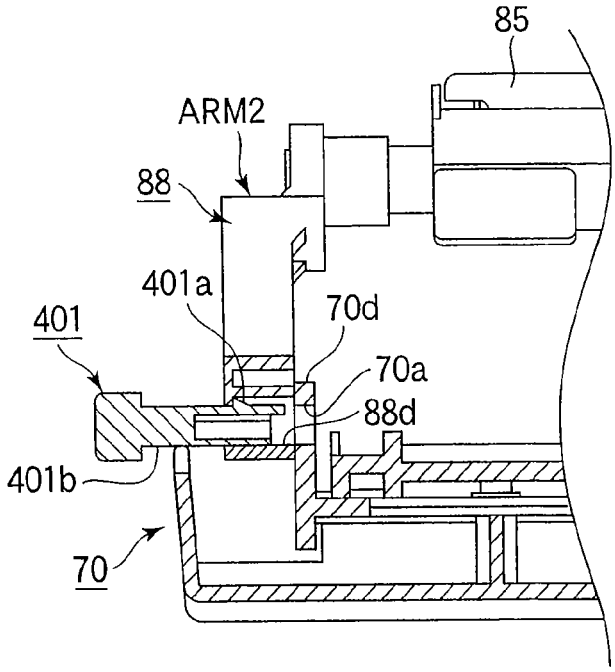

FIG. 41 is a perspective view of a feeder unit 201 and a paper tray 70 according to a ninth embodiment. FIGS. 42 and 43 illustrate the operation of a mounting piece 401.

Referring to FIGS. 42 and 43, a second arm ARM2 of a link 88 has a hole 88*d* formed in its end portion. A mounting piece 401 has an insertion 401*b* formed at its free end portion. The insertion 401*b* extends in its longitudinal direction, and has a resilient lance 401*a* that extends from the insertion 401*b* in the longitudinal direction of the insertion 401*b*. The insertion 401*b* of the mounting piece 401 is fitted into an elongated hole 70*a* (FIG. 41) through the hole 88*d*, thereby mounting the link 88 to the paper tray 70 so that the resilient lance 401*a* engages a frame 70*d* of the paper tray 70.

When the link 88 is disassembled from the paper tray 70, the operator operates the insertion 401*b* of the resilient lance 401*a* to flex radially inwardly so that the resilient lance 401*a* moves out of engagement with the frame 70*d*. Thus, the mounting piece 401 is allowed to move in a direction shown by arrow N. When the mounting piece 401 is moved in the N direction, the insertion 401*b* moves out of a fitting engagement with the elongated hole 70*a*, so that the link 88 can be disassembled from the paper tray 70. When the mounting piece 401 is moved further in the N direction, the resilient lance 401*a* is finally caught by the link 88 as shown in FIG. 43 so that the resilient lance 401*a* is prevented from being pulled out.

Because the link 88 is disassembled from the paper tray 70, the feeder unit 201 is allowed to pivot freely about a shaft 82*b* (same as shaft 82*b* in FIG. 29). When the feeder unit 201 is pivoted by about 90°, the feed roller 82 can be visually identified in its entirety as shown in FIG. 34.

As described above, the resilient lance 401*a* is allowed to engage the link 88 with the link 88 completely disassembled from the paper tray 70. The configuration of the mounting piece 401 eliminates the chance of the mounting piece 401 being lost when the operator replaces the feeder roller 82, simplifying the replacement operation of the feed roller 82.

Tenth Embodiment

Elements similar to those of the sixth embodiment have been given the same reference numerals and the description thereof is omitted.

Figure 44A:
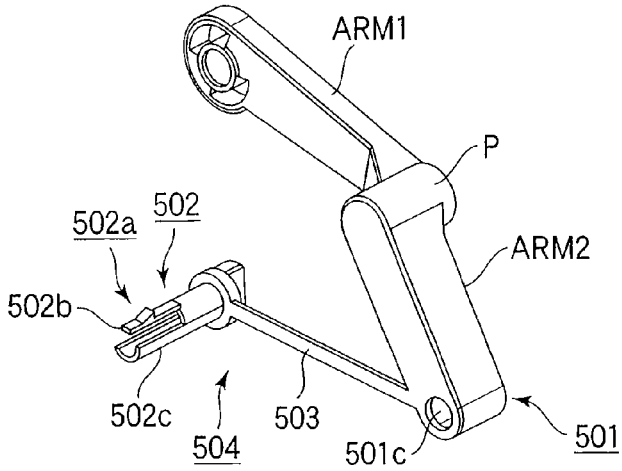
FIG. 44A is a perspective view of a link according to a tenth embodiment.
Figure 45:
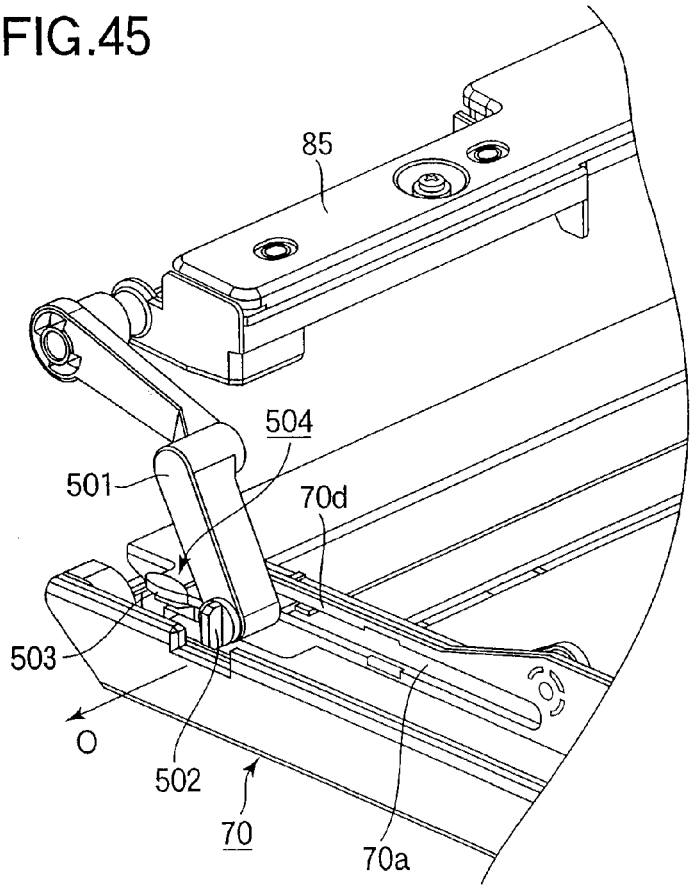
FIG. 45 is a perspective view of pertinent portions of a feeder unit and a paper tray.
Figure 44B:
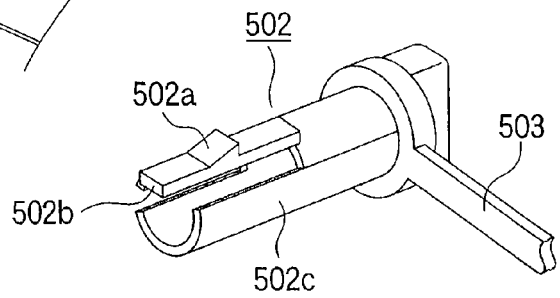
FIG. 44B is an enlarged fragmentary perspective view of a mounting piece of FIG. 44A.

FIG. 44A is a perspective view of a link 501 according to a tenth embodiment. FIG. 44B is an enlarged fragmentary perspective view of a mounting piece 502 of FIG. 44A. FIG. 45 is a perspective view of pertinent portions of a feeder unit and a paper tray 70.

Referring to FIGS. 44A and 45, the link 501 includes a first arm ARM1 and a second arm ARM2, which are connected to each other at their one ends and at a fixed angle with each other. A feeder frame 85 and the paper tray 70 are pivotally coupled to each other via the link 501. The link 501 is connected to the mounting piece 502 via a flexible coupling portion 503. The link 501, mounting piece 502, and coupling portion 503 form a mounting mechanism 504.

The second arm ARM2 has a hole 501*c* formed in its one longitudinal end portion and the mounting piece 502 has an insertion 502*c*. The mounting piece 502 has a resilient lance 502*a* formed thereon.

When the link 501 is mounted to the paper tray 70, the mounting piece 502 is first inserted into the hole 501*c* and then into an elongated hole 70*a*, and finally fastened into a frame 70*d*. Because the coupling portion 503 is made of a very resilient material, when the insertion 502*c* is fitted into the hole 501*c*, even if the coupling portion 503 is deformed to fold back, the coupling portion 503 is not broken.

When a link 88 is disassembled from the paper tray 70, a knob 502*b* of the resilient lance 502*a* is first moved radially inwardly of the insertion 502*c* so that resilient lance 502*a* is disassembled from the frame 70*d* and the mounting piece 502 can be pulled in a direction shown by arrow O. When the mounting piece 502 is pulled out in the O direction, the insertion 502*c* moves out of a fitting engagement with the elongated hole 70*a* so that the link 88 is disassembled from the paper tray 70. If the mounting piece 502 is further moved in the O direction, the resilient lance 502*a* moves into engagement with the link 501. Thus, the link 501 holds the resilient lance 502*a* to prevent the resilient lance 502*a* from being dismounted from the link 501.

As described above, the link 501 and the mounting piece 502 are connected via the coupling portion 503 at all times. Thus, when the user replaces the feed roller 82, there is no chance of the mounting portion being lost. Thus, the operation of replacing the feed roller 82 can be simplified.

Figure 46:
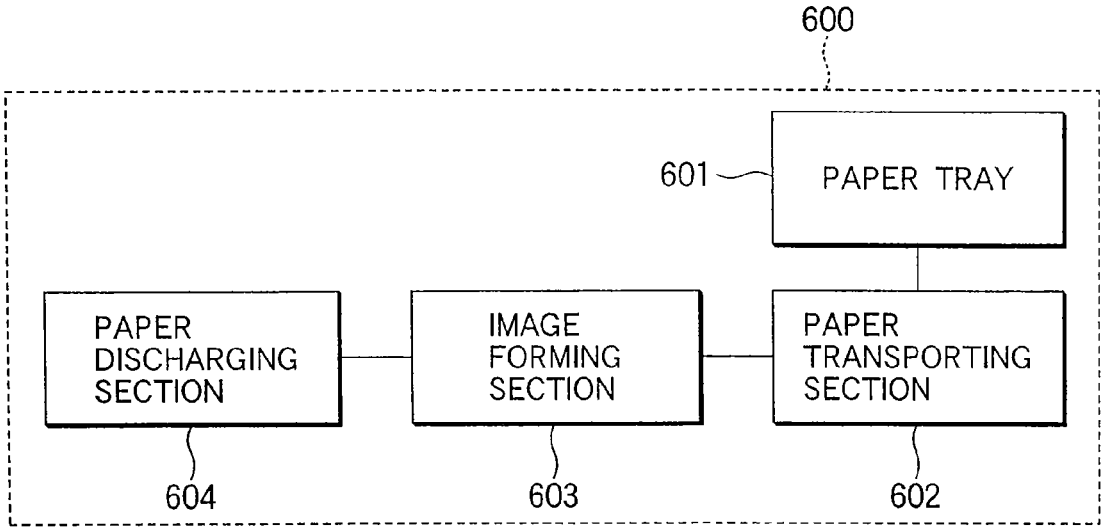
FIG. 46 illustrates an image forming apparatus of another type different from an electrophotographic printer.

The present invention may be applied to a variety of image forming apparatus, including a serial printer, as shown in FIG. 46. Referring to FIG. 46, a non-electrophotographic image forming apparatus 600 includes a paper tray 601, an image forming section 603 that forms an image, a medium transporting section 602 that transports a medium to the image forming section 603, and a medium discharging section 604 that discharges the medium onto which the image is transferred from the non-electrophotographic image forming section.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

We claim:

1. A medium supplying apparatus assembled to an image forming apparatus, the medium supplying apparatus comprising:

a medium tray that supports a stack of medium thereon, said medium tray being movable to open and close relative to the image forming apparatus;

a medium feeding section that feeds the medium from said medium tray, said medium feeding section being moved out of the image forming apparatus when said medium tray is opened relative to the image forming apparatus, and accommodated in the image forming apparatus when said medium tray is closed relative to the image forming apparatus;

an abutment portion formed on said medium feeding section, wherein when said medium tray moves to close relative to the image forming apparatus, said medium tray comes into contact with the abutment portion so that said medium tray drives said medium feeding section into the image forming apparatus; and an urging member that urges said medium feeding section in a direction in which said medium feeding section is moved out of the image forming apparatus; wherein when said medium tray is opened relative to the image forming apparatus, said medium tray moves out of contact with the abutment portion and said urging member urges said medium feeding section to move out of the image forming apparatus.

2. The medium supplying apparatus according to claim 1, wherein said medium feeding section includes:

a feed roller that causes the medium to advance from said medium tray; and a pair of rollers that advances only a top sheet of the medium caused by said feed roller to advance.

3. The medium supplying apparatus according to claim 2, wherein said medium feeding section comprises:

a first supporting member on which the pair of rollers is rotatably supported; and a second supporting member on which the feed roller is rotatably supported, the second supporting member is pivotal about a rotational axis of one of the pair of rollers.

4. The medium supplying apparatus according to claim 3, wherein said medium feeding section comprises a guide member supported such that the guide member is pivotal about a shaft in line with the rotational axis.

5. The medium supplying apparatus according to claim 4, wherein the urging member is mounted to the shaft.

6. The medium supplying apparatus according to claim 3, wherein when said medium tray opens relative to the image forming apparatus, the abutment portion abuts said medium tray to create a gap between said medium tray and said guide member.

7. A medium supplying apparatus assembled to an image forming apparatus, the medium feeding apparatus comprising:

a medium tray assembled to the image forming apparatus, said medium tray being movable to open and close relative to the image forming apparatus;

a medium feeding section that feeds the medium from said medium tray, wherein when said medium tray opens, said medium feeding section is moved out of the image forming apparatus, wherein when said medium tray closes, said medium feeding section is accommodated into the image forming apparatus;

an urging member that urges said medium feeding section in a direction in which said medium feeding section is moved out of the image forming apparatus; and an abutting member provided on said medium feeding section, wherein when said medium tray is moved to close, said abutting member comes into contact with said medium tray to create a predetermined gap between said medium tray and said medium feeding section; wherein when said medium tray is opened relative to the image forming apparatus. said medium tray moves out of contact with the abutment portion and said urging member urges said medium feeding section to move out of the image forming apparatus.

8. The medium supplying apparatus according to claim 1, wherein said medium tray includes a body and an extension slidingly extending from the body.

* * * * *